US011445779B2

(12) United States Patent
Hipp et al.

(10) Patent No.: US 11,445,779 B2
(45) Date of Patent: Sep. 20, 2022

(54) ARTICLE OF FOOTWEAR WITH MULTIPLE LAYERS, RETENTION SYSTEM FOR AN ARTICLE OF FOOTWEAR, AND METHODS OF MANUFACTURE

(71) Applicant: NIKE, Inc., Beaverton, OR (US)

(72) Inventors: Stephen J. Hipp, Hillsboro, OR (US); Fanny Y. Ho, Portland, OR (US); Bruce J. Kilgore, Lake Oswego, OR (US); Thomas J. Rushbrook, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 14 days.

(21) Appl. No.: 16/792,553

(22) Filed: Feb. 17, 2020

(65) Prior Publication Data

US 2020/0281302 A1 Sep. 10, 2020

Related U.S. Application Data

(63) Continuation of application No. 15/655,447, filed on Jul. 20, 2017, now abandoned.

(Continued)

(51) Int. Cl.
*A43B 1/04* (2022.01)
*A43B 23/02* (2006.01)

(Continued)

(52) U.S. Cl.
CPC ..... *A43B 1/04* (2013.01); *A43B 3/0031* (2013.01); *A43B 7/14* (2013.01); *A43B 23/024* (2013.01);

(Continued)

(58) Field of Classification Search
CPC ..... A43B 1/04; A43B 3/0031; A43B 23/0245; A43B 23/024; A43B 23/042; A43B 23/0265

See application file for complete search history.

(56) References Cited

U.S. PATENT DOCUMENTS 1,692,896 A * 11/1928 Hilgert ..... A43B 7/20 36/89
2,147,197 A * 2/1939 Glidden ..... A43B 23/0235 36/9 R (Continued)

FOREIGN PATENT DOCUMENTS

CN 104366870 A 2/2015
CN 105476181 A 4/2016

(Continued)

OTHER PUBLICATIONS

Final Office Action received for U.S. Appl. No. 15/655,447, dated Jul. 16, 2019, 16 pages.

(Continued)

*Primary Examiner* — Heather Mangine
(74) *Attorney, Agent, or Firm* — Shook, Hardy & Bacon L.L.P

(57) ABSTRACT

A knitted component may form at least a portion of an article of footwear. For example, a first knit layer may be located on an inner side of an article of footwear such that the first layer is adjacent to a void, and a second layer may at least partially surround the first layer and form an outer surface of the article of footwear. An interstitial space may be formed between the first layer and the second layer. At least one pocket may be located within the interstitial space.

15 Claims, 22 Drawing Sheets

Related U.S. Application Data

(60) Provisional application No. 62/491,898, filed on Apr. 28, 2017, provisional application No. 62/365,114, filed on Jul. 21, 2016.

(51) Int. Cl.
*A43B 3/00* (2022.01)
*D04B 1/26* (2006.01)
*A43B 7/14* (2022.01)

(52) U.S. Cl.
CPC ..... *A43B 23/0245* (2013.01); *D04B 1/26* (2013.01); *D10B 2403/023* (2013.01); *D10B 2501/043* (2013.01)

(56) References Cited

U.S. PATENT DOCUMENTS 2,586,045 A * 2/1952 Hoza ..... A43B 3/108 36/9 R
3,925,916 A * 12/1975 Garbuio ..... A43B 5/04 36/71
4,176,475 A * 12/1979 Arcamonte ..... A43B 23/042 36/9 R
4,317,292 A * 3/1982 Melton ..... A41B 11/007 36/9 R
4,373,215 A * 2/1983 Guigley ..... D04B 1/26 2/239
4,571,960 A * 2/1986 Hursh ..... D04B 1/26 66/196
4,615,188 A * 10/1986 Hursh ..... A41B 11/005 2/239
4,843,844 A * 7/1989 Hursh ..... D04B 1/02 66/196
5,325,541 A * 7/1994 Willard ..... A41B 11/005 2/239
5,581,817 A * 12/1996 Hicks ..... A41B 11/00 2/22
5,675,992 A * 10/1997 Wrightenberry ..... A41B 11/005 2/239
5,778,702 A * 7/1998 Wrightenberry ..... A41B 11/005 66/178 R
6,148,544 A * 11/2000 Keen ..... A43B 5/06 36/1.5
6,158,254 A * 12/2000 Richard ..... A41B 11/005 2/239
6,308,438 B1 * 10/2001 Throneburg ..... A43B 1/02 36/11
6,688,142 B2 * 2/2004 Higgins ..... A41B 11/005 2/239
6,862,902 B1 * 3/2005 Kim ..... A41B 11/005 66/178 R
7,370,438 B2 * 5/2008 Vattes ..... A43B 7/1465 36/10
8,463,657 B1 * 6/2013 Bentvelzen ..... A43B 19/00 705/26.1
9,392,835 B2 * 7/2016 Dekovic ..... D04B 1/104
9,578,925 B1 * 2/2017 Michel ..... A43B 3/0031
9,675,134 B2 * 6/2017 Kosui ..... D04B 1/26
2002/0029405 A1 * 3/2002 Outwater ..... A41B 11/00 2/239
2002/0092205 A1 * 7/2002 Hall ..... A43B 5/0439 36/117.1
2003/0089136 A1 * 5/2003 Lynch ..... D04B 1/26 66/187
2003/0115777 A1 * 6/2003 Hall ..... A43B 5/0401 36/117.6
2003/0145632 A1 * 8/2003 Roe ..... A41B 11/005 66/178 R
2004/0118018 A1 * 6/2004 Dua ..... A43B 1/14 36/45
2004/0181972 A1 * 9/2004 Csorba ..... A43C 11/14 36/50.1
2004/0205982 A1 * 10/2004 Challe ..... A43B 23/07 36/55
2005/0076541 A1 4/2005 Von
2005/0115284 A1 * 6/2005 Dua ..... A43B 23/042 66/178 R
2005/0193592 A1 * 9/2005 Dua ..... D04B 1/102 36/45
2006/0048413 A1 * 3/2006 Sokolowski ..... B32B 27/12 36/45
2008/0028635 A1 * 2/2008 Park ..... B29C 44/08 36/3 R
2008/0052955 A1 * 3/2008 Barrow ..... A43B 5/0405 36/2.6
2008/0110049 A1 * 5/2008 Sokolowski ..... D04B 1/22 36/50.1
2009/0158503 A1 * 6/2009 Duclos ..... A43B 19/00 2/239
2010/0050322 A1 * 3/2010 Zagula ..... A41B 11/006 2/239
2012/0011744 A1 1/2012 Bell et al.
2012/0233882 A1 * 9/2012 Huffa ..... A43C 1/00 36/45
2012/0246973 A1 * 10/2012 Dua ..... A43B 23/0275 36/83
2012/0266362 A1 10/2012 Craig
2012/0324764 A1 * 12/2012 Velez-Cruz ..... A43B 1/0036 36/137
2013/0104422 A1 * 5/2013 Hatfield ..... A43B 13/223 36/103
2013/0260104 A1 * 10/2013 Dua ..... A41D 27/245 428/175
2013/0312284 A1 * 11/2013 Berend ..... A43B 1/0072 36/84
2014/0115928 A1 * 5/2014 Pelletier, Jr. ..... A43B 5/04 36/116
2014/0137434 A1 * 5/2014 Craig ..... D04B 1/106 36/54
2014/0150292 A1 6/2014 Podhajny et al.
2015/0033585 A1 * 2/2015 Otus ..... A43C 11/12 36/109
2015/0189946 A1 * 7/2015 Nigri ..... A41B 11/006 2/239
2015/0313316 A1 * 11/2015 Boucher ..... A43B 23/0225 36/93
2015/0342286 A1 * 12/2015 Huffman ..... A43B 1/04 36/9 R
2016/0095377 A1 * 4/2016 Tamm ..... A43B 5/02 36/9 R
2016/0302524 A1 * 10/2016 Smith ..... A43C 1/04
2017/0129200 A1 * 5/2017 Adami ..... A43D 95/14
2017/0202311 A1 * 7/2017 Klug ..... A43B 1/04
2017/0208900 A1 * 7/2017 Boucher ..... A43B 23/0275
2017/0258620 A1 * 9/2017 Hammond ..... A61F 5/0111
2017/0280817 A1 * 10/2017 Hutchinson ..... A41D 27/10
2017/0306539 A1 * 10/2017 Gladish ..... A43B 23/0225
2017/0311672 A1 * 11/2017 Hipp ..... A43B 23/026
2018/0206585 A1 * 7/2018 Cai ..... A43B 1/04
2018/0332920 A1 * 11/2018 Burch ..... A43B 13/40
2020/0281302 A1 * 9/2020 Hipp ..... A43B 23/0235
2021/0368941 A1 * 12/2021 Chen ..... A43B 23/028

FOREIGN PATENT DOCUMENTS

TW M520275 U 4/2016
TW M559083 U 5/2018
WO WO 2016/012665 A1 1/2016

OTHER PUBLICATIONS

Final Office Action received for U.S. Appl. No. 15/655,447, dated Oct. 23, 2018, 24 pages.
Non-Final Office Action received for U.S. Appl. No. 15/655,447, dated Mar. 21, 2019, 19 pages.
Non-Final Office Action received for U.S. Appl. No. 15/655,447, dated Oct. 31, 2017, 19 pages.

(56) References Cited

OTHER PUBLICATIONS

Office Action for Taiwan Patent Application No. 106124490 dated Feb. 25, 2019 (with English translation) (17 pg.).
International Search Report and Written Opinion in International Application No. PCT/US2017/043109, dated Feb. 16, 2018, 21 pages.
Invitation to Pay Additional Fee in corresponding International Application No. PCT/US2017/043109, dated Nov. 3, 2017, 14 pages.
Office Action and English Translation in Corresponding Chinese Application No. 2017800509579, dated Jul. 13, 2020 (4 pages).
Office Action received for European Patent Application No. 17746314.8, dated May 18, 2022, 6 pages.

* cited by examiner

ARTICLE OF FOOTWEAR WITH MULTIPLE LAYERS, RETENTION SYSTEM FOR AN ARTICLE OF FOOTWEAR, AND METHODS OF MANUFACTURE

RELATED APPLICATIONS

This application, assigned U.S. application Ser. No. 16/792,553, and filed Feb. 17, 2020, is a continuation of U.S. patent application Ser. No. 15/655,447, filed Jul. 20, 2017, which claims the benefit of priority of U.S. Provisional Application No. 62/491,898, filed Apr. 28, 2017, and which also claims the benefit of priority of U.S. Provisional Application No. 62/365,114, filed Jul. 21, 2016. All applications listed in this paragraph are hereby incorporated by reference in their entireties.

BACKGROUND

Conventional articles of footwear generally include two primary elements: an upper and a sole structure. The upper is secured to the sole structure and forms a void within the article of footwear for comfortably and securely receiving a foot. The sole structure is secured to a lower surface of the upper so as to be positioned between the upper and the ground. In some articles of footwear, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. An ankle opening in a heel area generally provides access to the void in the interior of the upper. A lacing system is often incorporated into the upper to adjust the fit of the upper, thereby facilitating entry and removal of the foot from the void within the upper. The upper may include a tongue that extends under the lacing system to enhance adjustability of the footwear, and the upper may incorporate a heel counter to limit movement of the heel.

SUMMARY

One aspect of the present disclosure provides a knitted component forming an overfoot portion and an underfoot portion of an article of footwear. The knitted component may include a first layer defining a void and a second layer second layer at least partially surrounding the first layer. The second layer may form an outer surface on the overfoot portion and the underfoot portion, and a portion of the first layer may be continuous with a portion of the second layer in an ankle region of the knitted component. An interstitial space may be formed between the first layer and the second layer, and a component may be disposed between the first layer and the second layer.

In some embodiments, the first layer and the second layer may be formed on a circular knitting machine, and the second layer may be inverted with respect to the first layer. A seam may be formed at least in the second layer in a toe region of the knitted component. The seam may join the first layer to the second layer. A tension force of the second layer may retain the component in an underfoot area of the interstitial space. The interstitial space may be substantially free of adhesive. The component may be a midsole. The knitted component may further include a retention system formed in the second layer, the retention system having a plurality of first yarns and a plurality of second yarns, where the first yarns and the second yarns at least partially form the second layer of the knitted component, where the second yarns bias the retention system to a first state, and where the retention system exerts a tension force in a second state.

In another aspect, the present disclosure provides an upper with a first layer and a second layer, where the second layer at least partially surrounds the first layer, where a portion of the first layer is continuous with a portion of the second layer, and where the first layer is continuous with the second layer in at least a portion of an ankle region of the upper. A component may be disposed between the first layer and the second layer, where the component includes a material having different properties than the first layer and the second layer.

In some embodiments, the component may have a rigidity greater than the first layer and the second layer. The component may have a shape of a bootie that is coextensive with at least a forefoot region and a midfoot region of the upper. The bootie may be coextensive with a portion of a heel region. The component may have a greater stretch resistance than the first layer and the second layer. The first layer and the second layer may be formed by a knitted component. A pocket may be disposed between the first layer and the second layer, where the pocket receives the component. A seam that joins the first layer to the second layer in a toe region of the upper may be included.

In another aspect, the present disclosure includes a method of making an article of footwear. The method may include pulling an open toe region of an element towards a main fold line disposed between a first portion of the element and a second portion of the element so that an interior surface of the first portion of the element is exposed during the pulling operation, pulling the open toe region past the main fold line and onto the second portion so that the first portion substantially surrounds the second portion and a fold is formed in an ankle region of the article of footwear, aligning the open toe region of the element with a closed toe region of the second portion of the element, and forming a seam to join the open toe region with the closed toe region.

In some embodiments, the element may be a knitted component, and the method may further include forming the knitted component on a knitting machine. An interstitial space may be formed between the first portion and the second portion. The method may further include inserting a component between the first portion and the second portion in the interstitial space.

BRIEF DESCRIPTION OF THE DRAWINGS

The embodiments of the present disclosure can be better understood with reference to the following drawings and description. The components in the figures are not necessarily to scale, emphasis instead being placed upon illustrating the certain principles. Moreover, in the figures, like referenced numerals designate corresponding parts throughout the different views.

DETAILED DESCRIPTION

Figure 1:
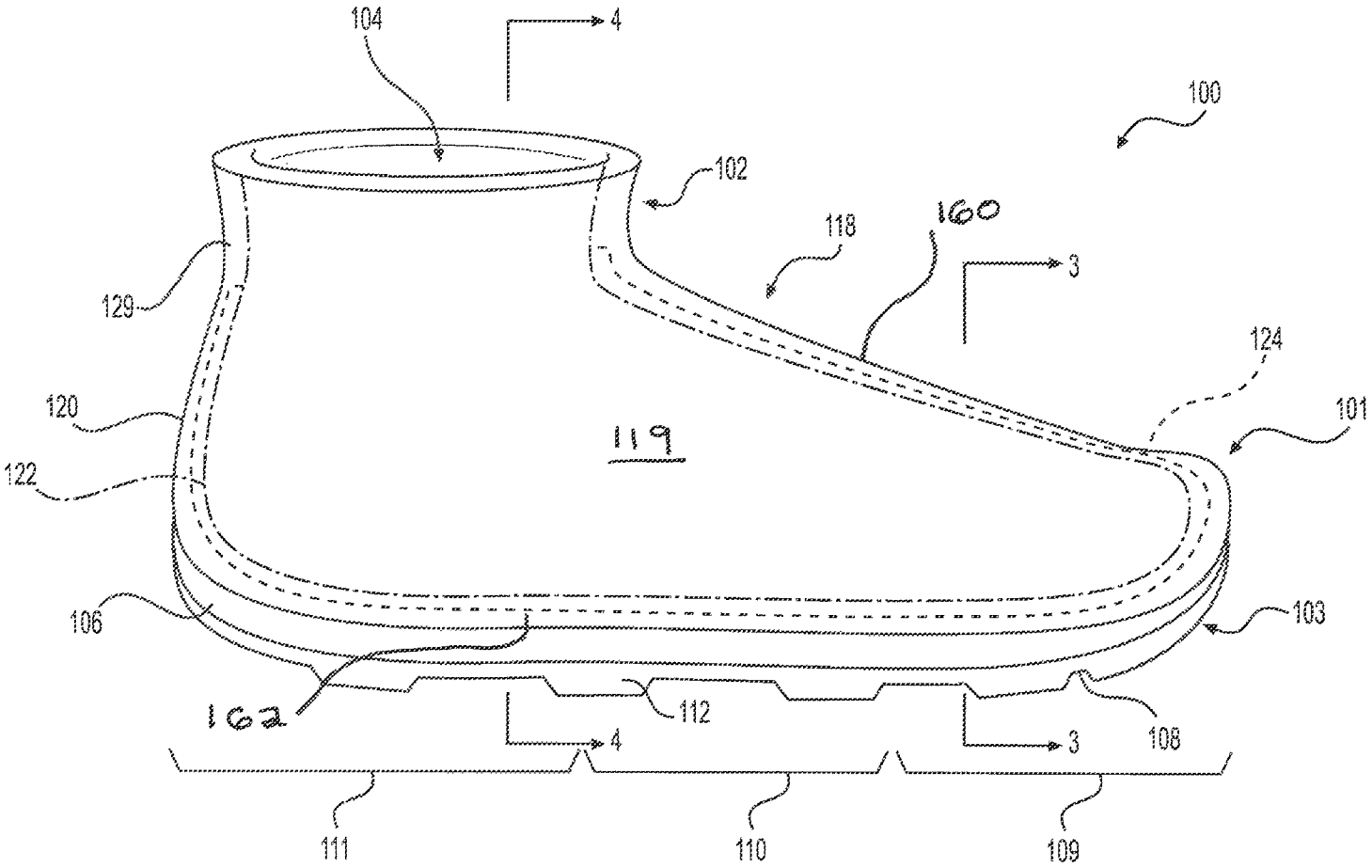
FIG. 1 is a perspective side view of an embodiment of an article of footwear having a multilayer upper with a component disposed between the layers of the upper.
Figure 2:
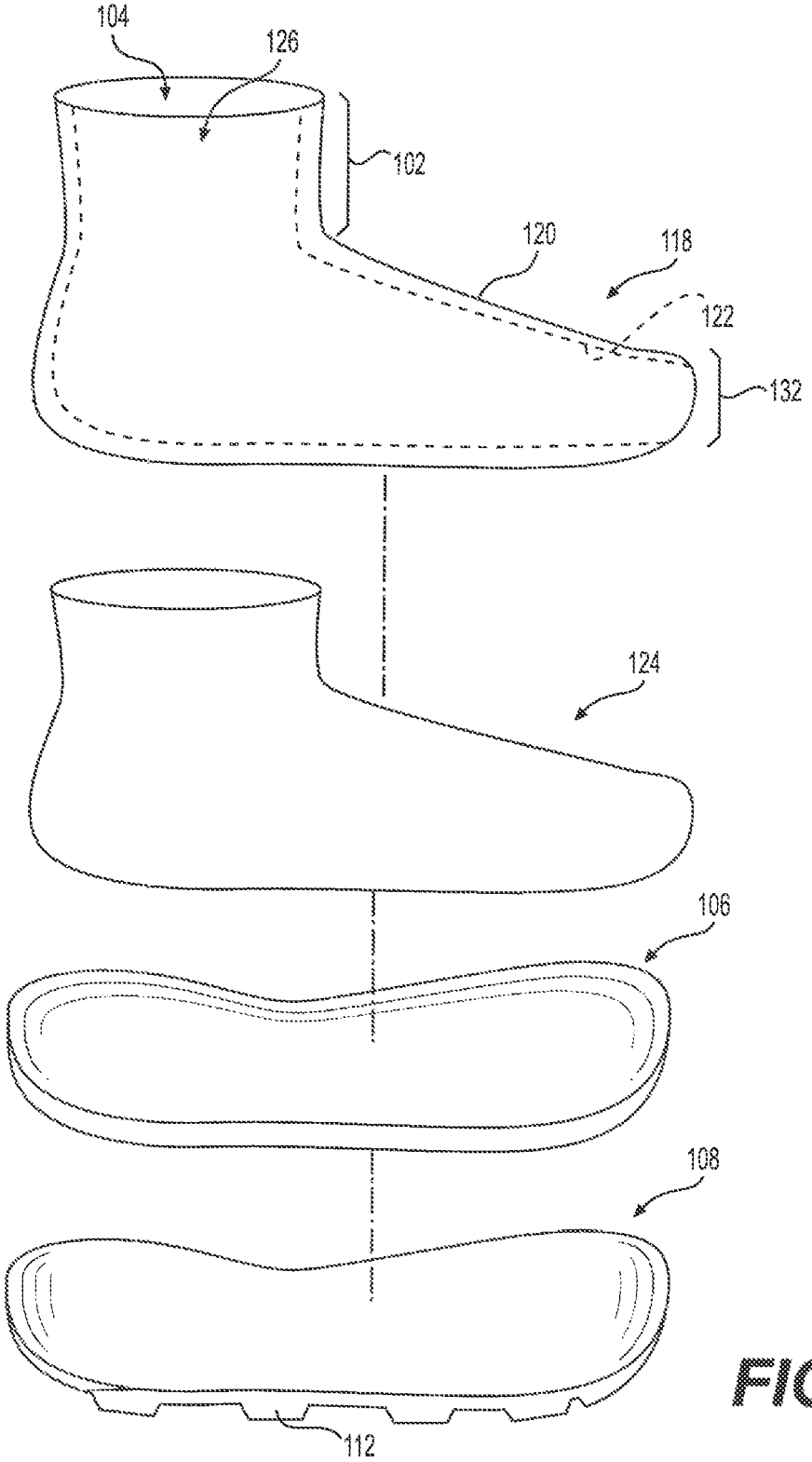
FIG. 2 is an exploded view of the embodiment of an article of footwear of FIG.

Referring to FIG. 1, a first embodiment of an article, such as an article of footwear 100 is shown. Article of footwear 100 includes an embodiment of an upper 101 with a component sandwiched between two layers and an optional sole structure 103. Article of footwear 100 is disclosed as having a general configuration suitable for walking or running. Concepts associated with the footwear, including upper 101, may also be applied to a variety of other athletic footwear types, including but not limited to baseball shoes, basketball shoes, cross-training shoes, cycling shoes, football shoes, soccer shoes, sprinting shoes, tennis shoes, and hiking boots. The concepts may also be applied to footwear types that are generally considered to be non-athletic, including dress shoes, loafers, sandals, and work boots. The concepts disclosed herein apply, therefore, to a wide variety of footwear types. Furthermore, the concepts disclosed herein may apply to articles beyond footwear, such as accessories or apparel.

In the embodiment of FIG. 1, upper 101 generally provides a comfortable and secure covering for the foot. The upper 101 may include an overfoot area 160 and an optional underfoot area 162 surrounding a void 119. As such, the foot of a wearer may be located within a void 119 to effectively secure the foot within article of footwear 100 or otherwise unite the foot and article of footwear 100. Moreover, sole structure 103 may be secured to a lower area (e.g., the underfoot area 162) of upper 101 or may partially or completely reside within a portion of the upper 101 such as an interstitial space as described below, and may be positioned between the foot and the ground to attenuate ground reaction forces (e.g., cushion the foot), provide traction, enhance stability, and/or influence the motions of the foot.

For reference purposes, article of footwear 100 upper 101 may be divided generally along a longitudinal axis (heel-to-toe) into three general regions: a forefoot region 109, a midfoot region 110, and a heel region 111. Forefoot region 109 generally includes portions of article of footwear 100 corresponding with the toes and the joints connecting the metatarsals with the phalanges. Midfoot region 110 generally includes portions of article of footwear 100 corresponding with an arch area of the foot. Heel region 111 generally corresponds with rear portions of the foot, including the calcaneus bone. Article of footwear 100 also includes a lateral side 107 and a medial side 105, which extend through each of forefoot region 109, midfoot region 110, and heel region 111 and correspond with opposite sides of article of footwear 100. More particularly, lateral side 107 corresponds with an outside area of the foot (i.e., the surface that faces away from the other foot), and medial side 105 corresponds with an inside area of the foot (i.e., the surface that faces toward the other foot). Forefoot region 109, midfoot region 110, heel region 111, lateral side 107, and medial side 105 are not intended to demarcate precise areas of article of footwear 100. Rather, forefoot region 109, midfoot region 110, heel region 111, lateral side 107, and medial side 105 are intended to represent general areas of article of footwear 100 to aid in the following discussion.

In some embodiments, sole structure 103 may generally include a midsole 106 and/or an outsole 108. A midsole 106 may be secured to a lower surface of upper 101, or may be positioned within an interstitial space 129 between an outer knit layer 120 and an inner knit layer 122, as described below. When midsole 106 occupies the interstitial space 129, tension in the outer knit layer 120 may retain midsole 106 in an underfoot position between the inner knit layer 122 and outer knit layer 120. The midsole 106 may reside within the interstitial space 129 with or without additional elements to retain the midsole 106 in the underfoot area, for example adhesives, stitches, heat bonding, RF welding, or sonic welding. The absence of adhesives retaining midsole 106 within the interstitial space 129 may advantageously contribute to more compliant and reactive on-foot feel. However, outsole 108 may be additionally or alternatively be secured to the lower surface of upper 101 with the use of an adhesive or other suitable mechanical or chemical mechanisms or means. Midsole 106 may be formed from a compressible polymer foam element (e.g., a polyurethane or ethylvinylacetate foam) that attenuates ground reaction forces (e.g., provides cushioning) when compressed between the foot and the ground during walking, running, or other ambulatory activities. Additionally or alternatively, midsole 106 may incorporate plates, moderators, fluid-filled chambers, lasting elements, and/or motion control members that further attenuate forces, enhance stability, or influence the motions of the foot.

An outsole 108 having a ground-engaging surface can be disposed at a lower surface of midsole 106 or a lower surface of upper 101 in some embodiments. The outsole 108 may be at least partially formed with a textured wear-resistant rubber material, thus providing a tread element 112 to impart traction.

Although the depicted configuration of sole structure 103 provides an example of a sole structure that may be used in connection with upper 101, a variety of other configurations for sole structure 103 may alternatively be used. In some embodiments, for example, an external sole structure 103 may be omitted, and portions of upper 101 may be treated or otherwise configured to provide a suitable ground-engaging surface.

As depicted, upper 101 includes a first or outer knit layer 120 and a second or inner knit layer 122. In some embodiments, outer knit layer 120 substantially surrounds inner knit layer 122, and outer knit layer 120 may form an exterior surface 121 (shown in FIGS. 4A-4B) of upper 101. In some embodiments, such as shown in FIG. 1, outer knit layer 120 entirely covers inner knit layer 122 so that inner knit layer 122 is not visible from an exterior perspective after assembly. In other embodiment, outer knit layer 120 covers only a portion of inner knit layer 122 so that another portion of inner knit layer 122 is visible after assembly from the exterior perspective.

Outer knit layer 120 and inner knit layer 122 are arranged or otherwise configured in some embodiments to create an interstitial space 129 (e.g., a gap) between outer knit layer 120 and inner knit layer 122. One or more component(s) 124 may be positioned in interstitial space 129 between outer layer 120 and inner layer 122. Component 124 may be a bootie, midsole, cleat plate, a water-resistant membrane, or any other suitable device. Thus as shown in FIG. 1, a three-layer upper may be provided with an outer knit layer 120, an inner knit layer 122, and the component 124 positioned between outer knit layer 120 and inner knit layer 122.

In some embodiments, the component 124 disposed in interstitial space 129 may be structured or otherwise configured to provide a specific shape to upper 101 such that the upper 101 is able to hold a specific shape when a foot is not disposed within upper 101 (e.g., when the other layers of upper 101 lack the structural characteristics to hold a desirable three-dimensional shape on their own). For example, in some embodiments, such as the embodiment shown in FIG. 1, the component 124 may advantageously facilitate the article of footwear retaining a shape typical of athletic footwear with or without receipt of a foot within the void.

In some embodiments, such as the embodiment shown in FIGS. 1-4A, the component 124 is a bootie. Component 124, as shown best in FIG. 2, may have the general configuration of an athletic upper. Component 124 may be configured (e.g., sized and shaped) to receive and/or substantially cover a foot of a user when the foot is inserted into upper 101. Component 124 may be made of a material that has sufficient rigidity and/or stiffness to maintain its established three-dimensional shape, and may include a material that is more rigid or stiff than the outer knit layer 120 and the inner knit layer 122. In some embodiments, component 124 may be a single layer of material. Additionally or alternatively, component 124 may be made from a nonwoven textile (and it is noted that a knitted textile is distinct from a nonwoven textile). In some embodiments, component 124 may include thermoplastic or thermoset portions so that component 124 may be heat set to hold a specific shape.

Figure 4A:
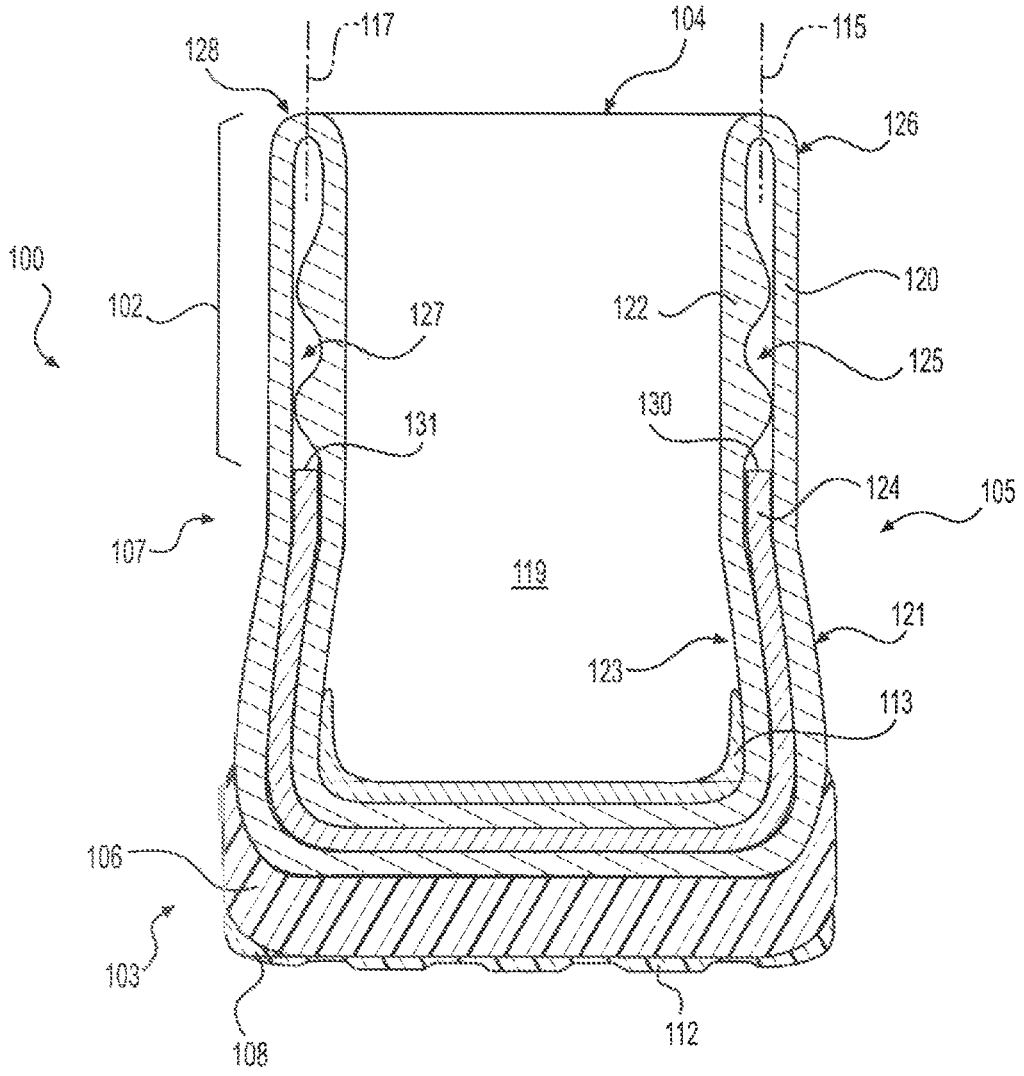
FIG. 4A is a cross-sectional view of a heel region of the embodiment of the article of footwear of FIG. 1, where the cross-section is taken along line 4-4.
Figure 4B:
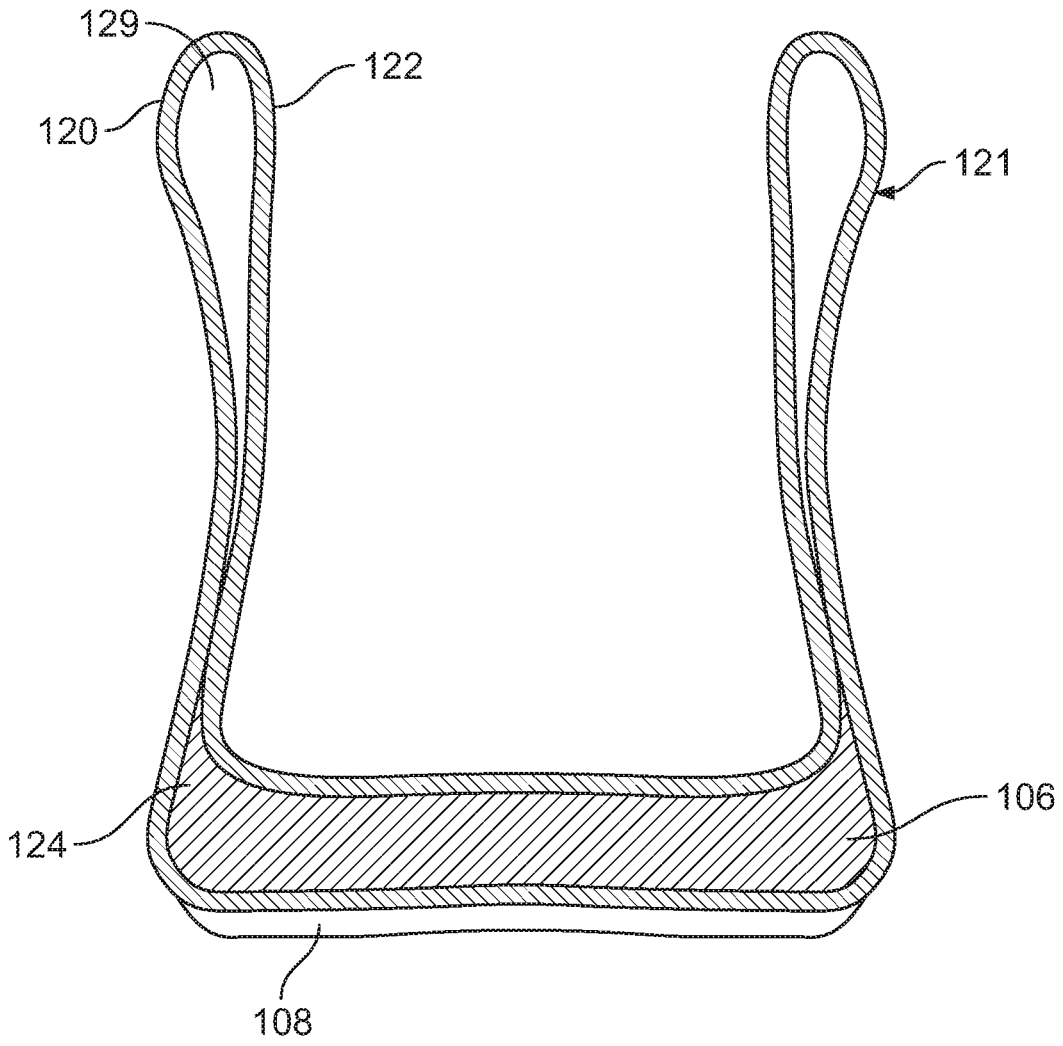
FIG. 4B is a cross-sectional view of a heel region of another embodiment of an article of footwear.

In some embodiments, such as the embodiment shown in FIG. 4B, component 124 is a midsole 106 positioned within interstitial space 129. Tension in outer layer 120 may retain midsole 106 in an underfoot position between inner layer 122 and outer layer 120, for example. Midsole 106 may reside within interstitial space 129 with or without additional elements to retain midsole 106 in the underfoot area, for example adhesives or stitches. In embodiments where the midsole 106 resides within the interstitial space 129 without additional elements securing it to the outer or inner knit layers 120, 122, the midsole 106 may better conform to a wearer's foot during ambulatory activities due to the elimination of at least one flexibility-reducing adhesive layer. Additionally, the elimination of adhesive may advantageously reduce the need for certain materials and/or manufacturing steps, which may increase manufacturing efficiency and lower the overall cost of the article of footwear. As described above, midsole 106 may be formed from one or more materials that provide cushioning when compressed between the foot and the ground during walking, running, or other ambulatory activities. Midsole 106 may also (or alternatively) incorporate other elements that further attenuate forces, enhance stability, or influence the motions of the foot.

Component 124 may be made of multiple layers of material. Optionally, component 124 may include provisions for cushioning, such as relatively thick portions, inflatable portions, foam portions, or the like. Additionally or alternatively, component 124 may include provisions for protection, such as thicker portions, rigid portions such as plates, stiffened portions, or the like. In some embodiments, component 124 may have apertures or may otherwise include discontinuities so that component 124 essentially provides a scaffold that establishes the three-dimensional shape while retaining breathability and flexibility.

Figure 3:
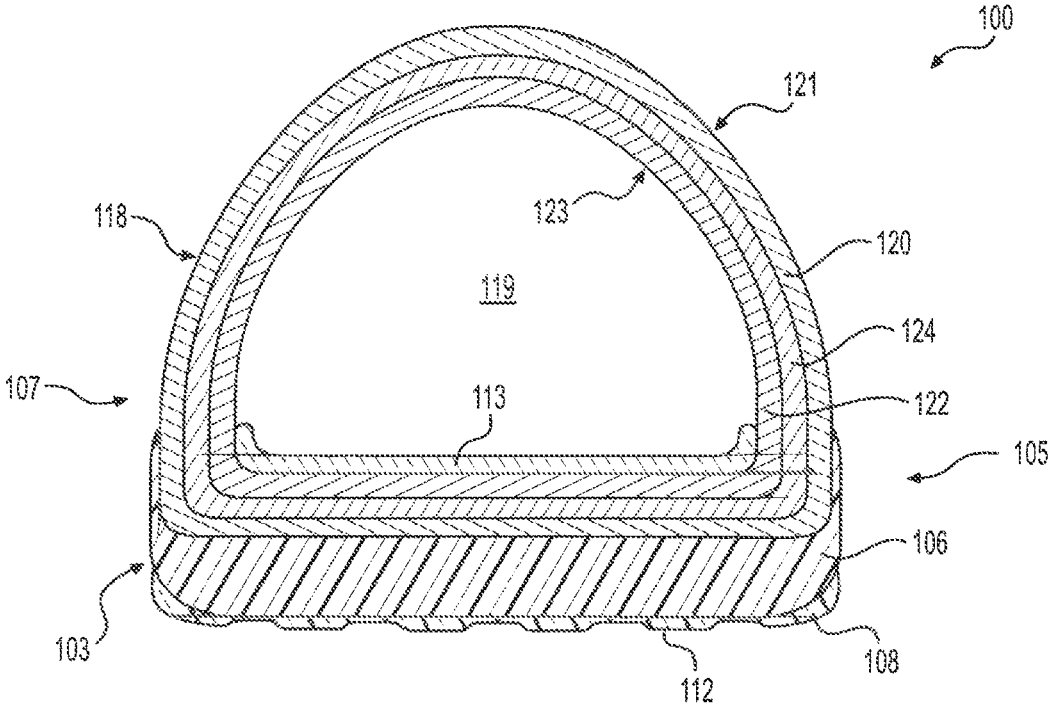
FIG. 3 is a cross-sectional view of a forefoot region of the embodiment of the article of footwear of FIG. 1, where the cross-section is taken along line 3-3.

As shown in FIG. 3, component 124 may establish the shape of an interior void 119, which is the opening within upper 101 into which a foot of a user is inserted for use. An interior surface 123 of inner knit layer 122 may define and form a surface of interior void 119. When inner knit layer 122 is formed of a relatively flexible knit, inner knit layer 122 may have difficulty in maintaining a specific, three-dimensional shape such as the shape shown in FIG. 3. Thus, component 124 may communicate with the inner knit layer 122 to established and retain a suitable shape of interior void 119.

Component 124 may be coextensive with outer knit layer 120 and/or inner knit layer 122 at least at some locations and not at others. Referring to FIG. 4A, which shows a cross-section of upper 101 taken along line 4-4 in heel region 111, component 124 is coextensive with outer knit layer 120 and inner knit layer 122 at a bottom portion of article of footwear 100. Upper or top edges of component 124 terminate within ankle region 102 of upper 101 while outer knit layer 120 and inner knit layer 122 extend beyond the component 124 to form ankle region 102. Specifically, component 124 extends from a lateral bootie top edge 131 on lateral side 107 to a medial bootie top edge 130 on medial side 105. Outer knit layer 120 and inner knit layer 122 extend beyond lateral bootie top edge 131 and medial bootie top edge 130 to form ankle region 102 and join at medial fold 126 and lateral fold 128. As shown in FIG. 4A, in ankle region 102, medial interstitial space 125 and lateral interstitial space 127 are empty, allowing ankle region 102 to behave and/or have characteristics more like a traditional sock. For example, ankle region 102 may have the flexibility to conform to the ankle of a wearer during use and/or to have suitable stretchability to accommodate the insertion and removal of the foot of a wearer.

Figure 5:
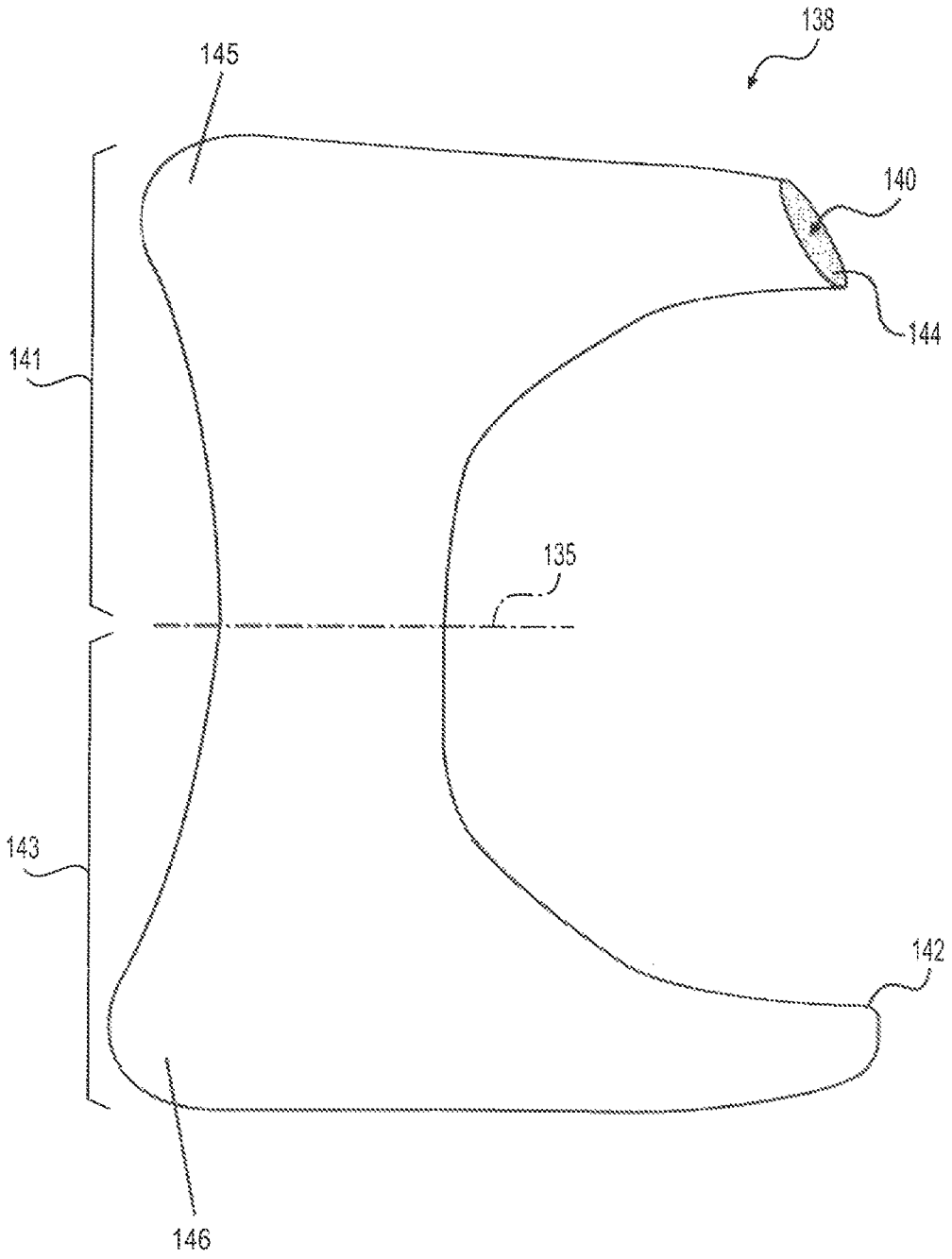
FIG. 5 is an embodiment of an unfolded knit element that may be used to form a multilayer knit upper.

In some embodiments, outer knit layer 120 and inner knit layer 122 are made from a common knit element 118 that is folded to form the layers 120 and 122. In the embodiment shown in FIG. 1, knit element 118 has been doubled over to form two layers. One embodiment of such an unfolded knit element 138 is shown in FIG. 5. Making both layers of knit element 118 of upper 101 from a common unfolded knit element 138 may reduce costs, both in terms of knitting time and waste reduction, but also because folding unfolded element 138 into the folded orientation of knit element 118 may take less time and labor than aligning two separate pieces of material and joining the separate pieces of material together.

FIGS. 5-8 show an embodiment of turning unfolded element 138 into a double-layer knit element like knit element 118. FIG. 5 shows an embodiment of unfolded element 138, where unfolded element 138 has a generally tubular, sock-like configuration. Unfolded element 138 includes two portions: a first portion 141 and a second portion 143. First portion 141 and second portion 143 may be nearly identical in shape, though mirror-images and/or oppositely-oriented generally symmetrical portions. In some embodiments, first portion 141 and second portion 143 may have a foot-like shape with a toe such as first toe 140 and second toe 142, and a shaped heel such as first heel 145 and second heel 146.

In the illustrated embodiment of FIG. 5, first portion 141 includes a first or open toe 140 so that a portion of an interior surface 144 of unfolded element 138 is visible. In contrast, the second portion 143 may have a second or closed toe 142, that is closed either by joining edges together during a post-knitting process, during knitting (e.g., edges joined by a knit structure of the knit element 118 formed on a knitting machine), or otherwise closed by desirable or accepted methods. Closed toe 142 may alternatively be left open, at least initially, for example, in a manner like open toe 140. In such embodiments, closed toe 142 may ultimately be closed to form a seam as discussed below in forming a seam to join open toe 140 to inner knit layer 122.

Unfolded element 138 may be made using a suitable knitting process. In some embodiments, unfolded element 138 may be manufactured on a circular knitting machine. In some embodiments, first portion 141 and second portion 143 are made from the same type of yarn and with the same type of knit stitches. In other embodiments, first portion 141 and second portion 143 may be made from different types of yarn, different knit stitches and/or other knit structures, and/or with different knit stitch densities. Similarly, within each portion, first portion 141 and second portion 143 may be made with the same type of yarn and with the same type of knit stitches or other knit structures. In other embodiments, within first portion 141, first portion 141 may include different types of yarn, different knit stitches or other knit structures, and/or different knit stitch densities. Similarly, second portion 143 may include different types of yarn, different knit stitches or other knit structures, and/or different knit stitch densities within second portion 143.

First portion 141 and second portion 143 may be considered to be divided by a main fold line 135. Main fold line 135 may be an imaginary line that apportions unfolded element 138 into first portion 141 and second portion 143. In some embodiments, main fold line 135 may divide unfolded element 138 approximately in half. In other embodiments, first portion 141 may be slightly larger than second portion 143, which may be advantageous when first portion 141 will be folded over second portion 143, although it is also contemplated that second portion 143 may be larger. First portion 141 may, in some embodiments, surround or substantially surround second portion 143 to form outer knit layer 120. Thus, when first portion 141 is not substantially larger than second portion 143, first portion 141 may have sufficient stretch to encompass second portion 143 and to allow for interstitial space 129. In these embodiments, the tension in the yarns of first portion 141 may assist in holding any components positioned in interstitial space 129 in a desired position.

Figure 6:
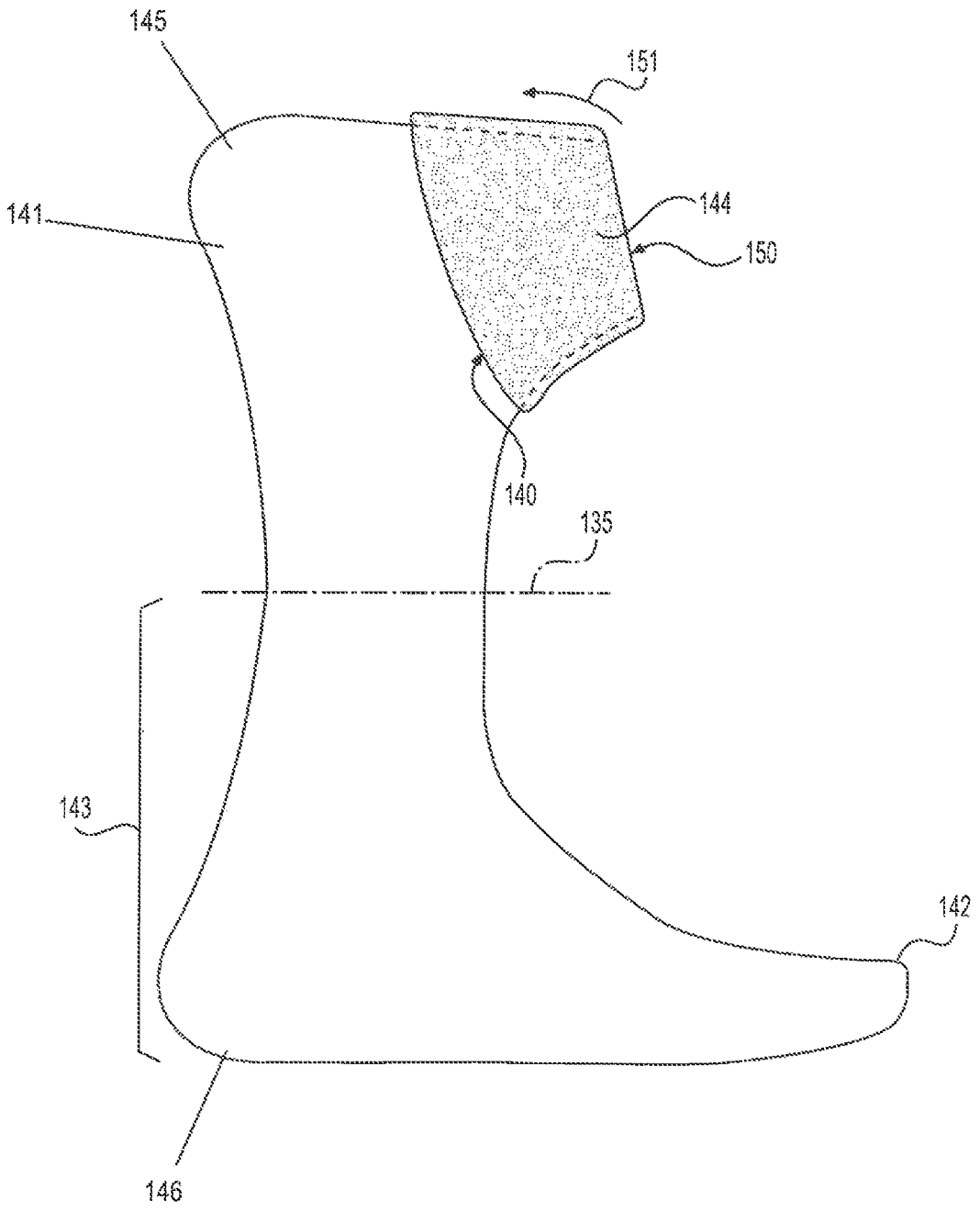
FIG. 6 depicts an embodiment of a first step in forming a multilayer knit upper from the unfolded knit element shown in FIG. 5.

As shown in FIG. 6, a step in forming knit element 118 from unfolded element 138 includes grasping open toe 140 and turning the open end of first portion 141 essentially inside-out so that interior surface 144 becomes an exterior surface and first intermediate fold 150 is formed in first portion 141. In some embodiments, in the final product, interior surface 144 of unfolded element 138 becomes exterior surface 121 (shown in FIG. 3). After first portion 141 is turned or flipped inside-out, open toe end 140 is pulled in first fold direction 151. First fold direction 151 is in the direction towards main fold line 135.

Figure 7A:
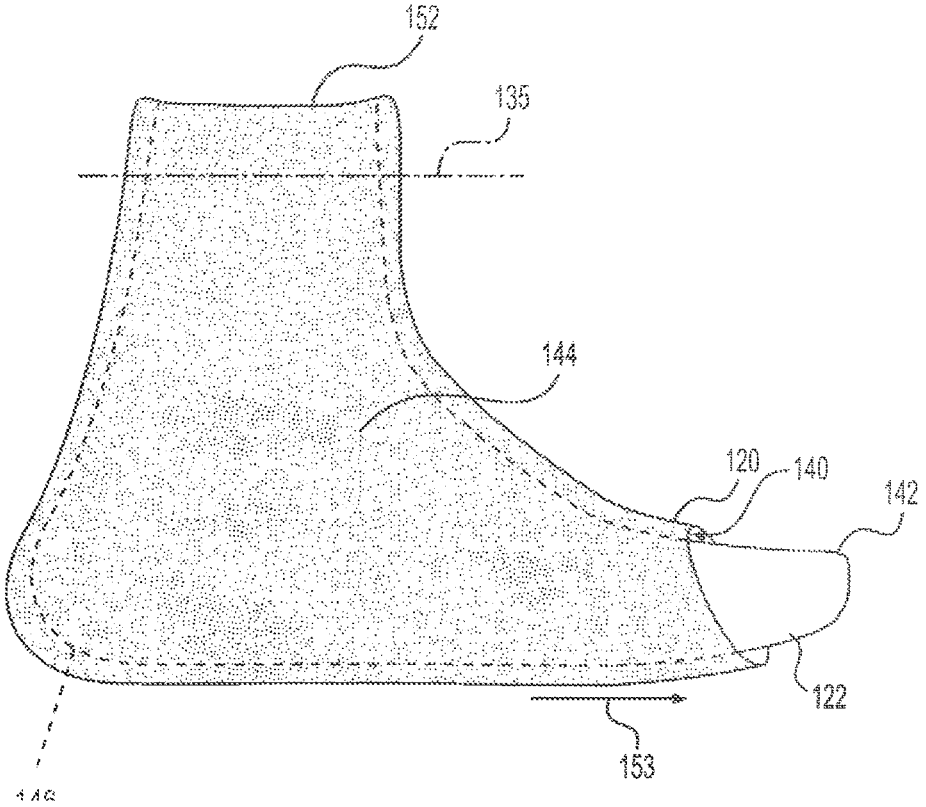
FIG. 7A depicts an embodiment of a second step in forming a multilayer knit upper from the unfolded knit element shown in FIG. 5.

FIG. 7A shows a subsequent point in the folding process. As shown, open toe 140 has been pulled past first portion heel 145 as shown in FIG. 6 so that first portion heel 145 is also turned inside out. Open toe 140 is also depicted as pulled past second portion heel 146 in a second fold direction 153. Open toe 140 is shown as approaching closed toe 142. At this stage, interior surface 144 may form a majority of an exterior surface of the illustrated element. The wearable orientation of outer knit layer 120 and inner knit layer 122 is, at this point, more clearly visible.

Figure 7B:
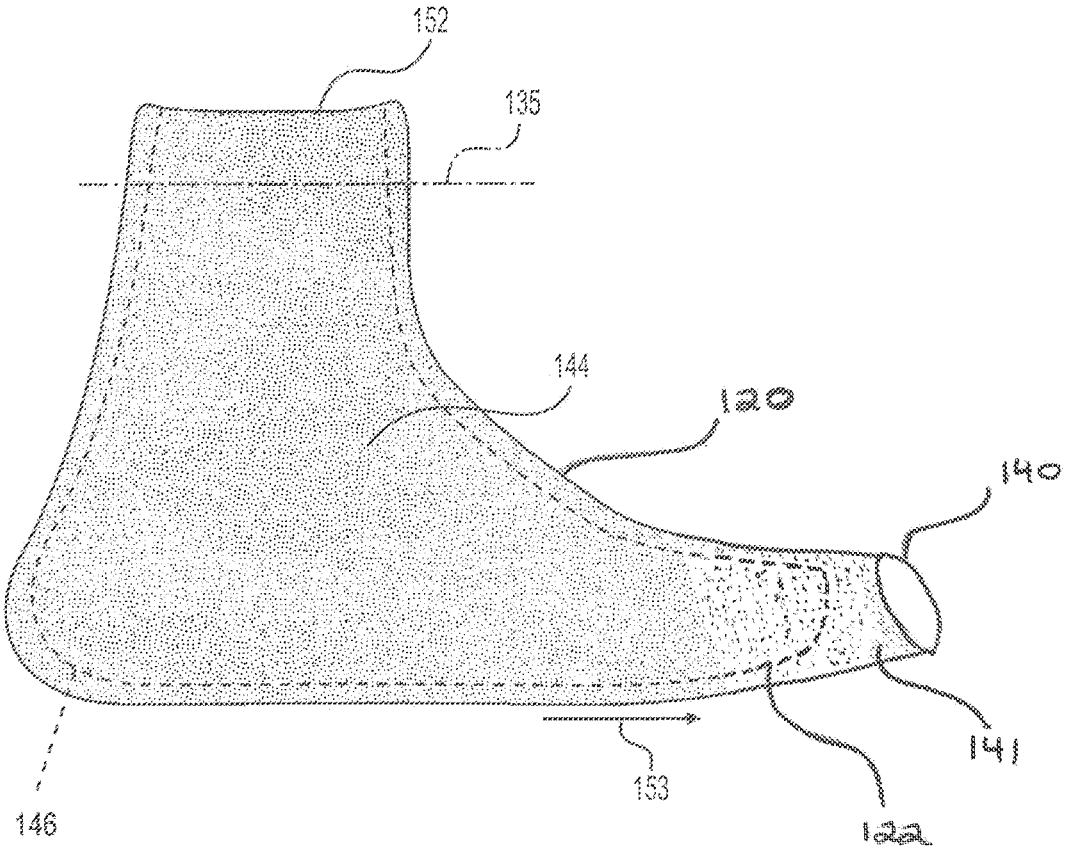
FIG. 7B depicts an embodiment of a third step in forming a multilayer knit upper from the unfolded knit element shown in FIG. 5.

FIG. 7B shows yet another optional point in the folding process, wherein open toe 140 is pulled past closed toe 142 prior to the final step. By pulling open toe 140 past closed toe 142, technical properties and/or aesthetic qualities of outer knit layer 120 may extend up to and be coterminous with closed toe 142. Furthermore, at this stage, pulling open toe 140 past closed toe 142 may enable forming a toe seam 132 by alternative post-process methods, described below.

Figure 8:
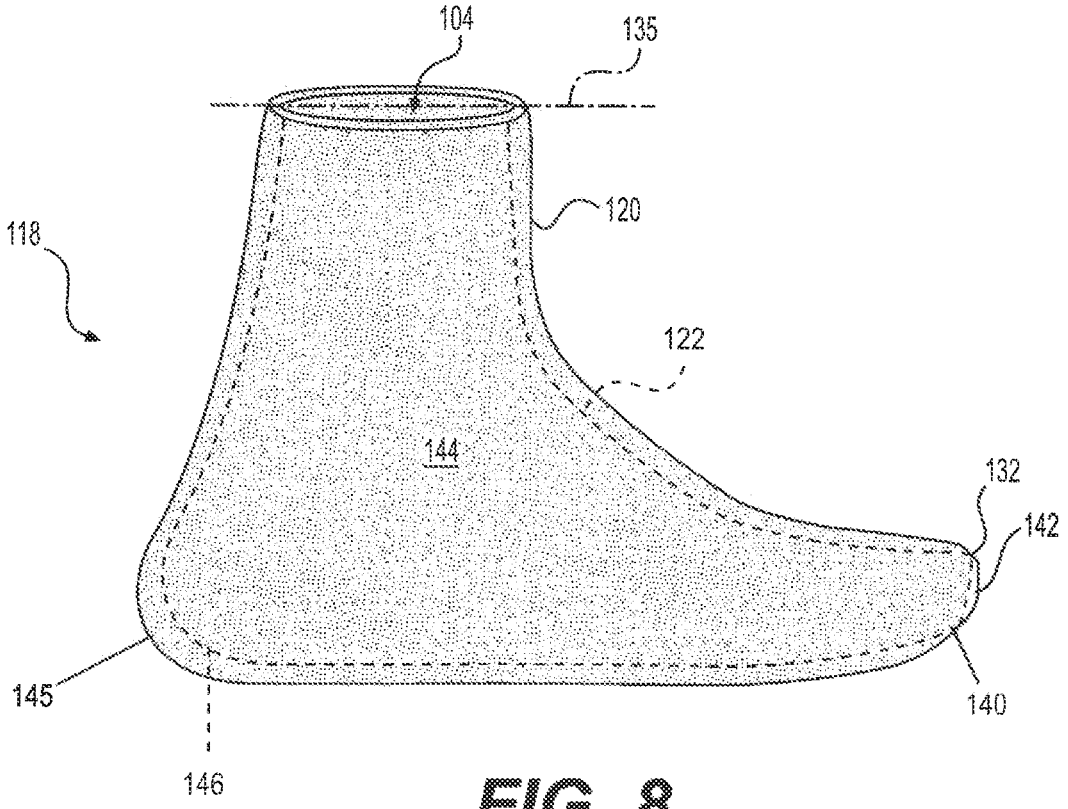
FIG. 8 depicts an embodiment of a completed multilayer knit upper formed from the unfolded knit element shown in FIG. 5.

FIG. 8 shows an embodiment of a final step in the folding process. In this step, open toe 140 may be pulled proximate closed toe 142. In some embodiments, such as the illustrated embodiment, open toe 140 aligns with closed toe 142. In other embodiments, open toe 140 may fall short of closed toe 142 or be pulled past closed toe 142 (as shown in FIG. 7B). In embodiments where open toe 140 may be pulled past closed toe 142, outer knit layer 120 may be temporarily joined with closed toe 142 prior to forming the toe seam 132. Also, an excess portion 141 of outer knit layer 120 that extends beyond closed toe 142 may be removed prior to or subsequent to forming the toe seam 132. Open toe 140 may be affixed to inner knit layer 122 to form the toe seam 132, which may be positioned in an over-toe area, and underfoot area, or other area.

Toe seam 132 may be formed by one or more steps, including but not limited to stitching, adhesive bonding, heat bonding if the yarns of outer knit layer 120 and inner knit layer 122 include thermoset or thermoplastic properties, welding through an RF welding or sonic welding process, or the like. Heat bonding, RF welding, and sonic welding may provide benefits over other types of joining process by reducing labor costs and material waste, by enabling toe seam 132 to have smaller dimensions and/or reside below a bite line where it is not visible (for example in an underfoot area), and/or by providing a seamless on-foot feel to the user (for example, by eliminating "ears" created on the medial and lateral portions of the toe area by traditional toe-closing steps such as stitching). Any of the foregoing methods to form toe seam 132 may be carried out as a post-process step, i.e., after the upper is removed from a knitting machine.

When outer layer 120 and inner layer 122 are in their wearable configuration, as shown in FIG. 8, knit element 118 may extend from toe seam 132 to main fold line 135. Proximate main fold line 135 is a foot insertion opening 104. Also proximate main fold line 135 is a main fold. As shown in FIGS. 4A-B, main fold is shown at a top of ankle region 102 and includes a medial fold 126 and a lateral fold 128. The main fold may be continuous around foot insertion opening 104. Medial fold 126 and lateral fold 128 may be formed when first portion 141 fully overlaps second portion 143. Main fold at main fold line 135 (shown in FIG. 8) may be a bend in knit element 118 that preserves the nature (e.g. the continuity) of unfolded knit element 138 while forming two distinct layers: outer knit layer 120 and inner knit layer 122.

In some embodiments, component 124 may be positioned on first portion 141 and/or second portion 143 or between these portions 141 and 143 prior to or during the folding of unfolded element 138 into knit element 118. In one particular example (e.g., when the component 124 is a bootie as depicted), second portion 143 may be inserted into component 124 then first portion 141 may be folded around component 124. In other embodiments, component 124 (and/or other components) may be inserted between first portion 141 and second portion 143 after portions 141 and 143 are substantially folded or otherwise manipulated into their wearable orientation.

FIGS. 9-19 show various embodiments of an article of footwear with a knitted element, where different components and/or knit structures are used in different zones of an article of footwear to achieve different properties in different zones. For example, different portions or zones of an article of footwear may benefit from different structural or performance properties. In some zones, such as in the forefoot region, breathability and flexibility are beneficial. In other zones, such as in a heel or toe, rigid support and protection may be beneficial.

In the embodiment(s) shown in FIGS. 9-13, an article of footwear 200 includes an upper 201 and an optional sole structure 203. In most respects, upper 201 is similar to upper 101 and second sole structure 203 is similar to sole structure 103, both of which are discussed above with reference to FIGS. 1-8. For example, second knit element 218 may optionally be made from the same materials and folded in the same way as knit element 118 discussed above. In some embodiments, such as the embodiment shown in FIGS. 9-13, second knit element 218 may include at least one zonal pocket which is configured to contain at least one zonal insert.

Upper 201 may include zonal pockets sandwiched between a first knit layer 220 and a second knit layer 222. Zonal pockets and inserts may be provided to produce different responses and properties in different parts of article of footwear 200. In the embodiment shown in FIG. 9, three zonal pockets are provided: a first zonal pocket 230 disposed in second heel region 211, a second zonal pocket 232 disposed on a medial side 205 of second midfoot region 210, and a third zonal pocket 234 disposed in a toe region of second forefoot region 209. As shown best in FIG. 11, first zonal pocket 230 is configured to receive a first zonal insert 231 within a first pocket interior 236, second zonal pocket 232 is configured to receive a second zonal insert 233 within a second pocket interior 238, and third zonal pocket 234 is configured to receive a third zonal insert 235 within a third pocket interior 240.

Greater or fewer zonal pockets may be provided in other embodiments. In some embodiments, the number of zonal pockets may exceed the number of zonal inserts. For example, when a single design of knit element 218 is provided for a number of different configurations, some of the pockets may remain empty in some configurations. In other embodiments, the number of zonal pockets may be less than the number of zonal inserts, such as when zonal inserts may be provided in a kit for interchangeability or when more than one zonal insert is intended to be positioned in a zonal pocket for a finer degree of control over the properties contributed by the zonal inserts.

Figure 9:
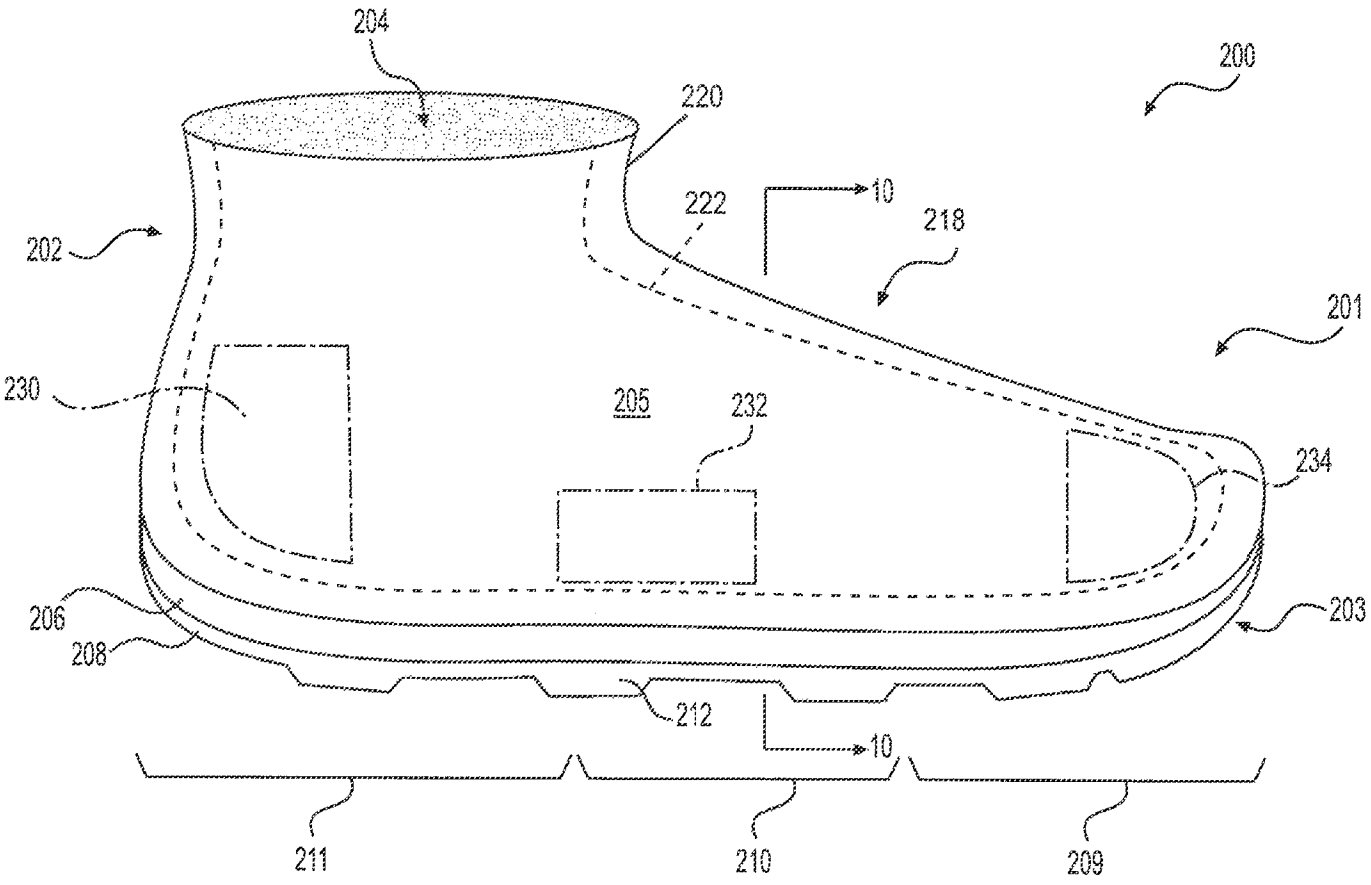
FIG. 9 depicts a perspective side view of an embodiment of an article of footwear having a multilayer upper with various zonal pockets and inserts.
Figure 10:
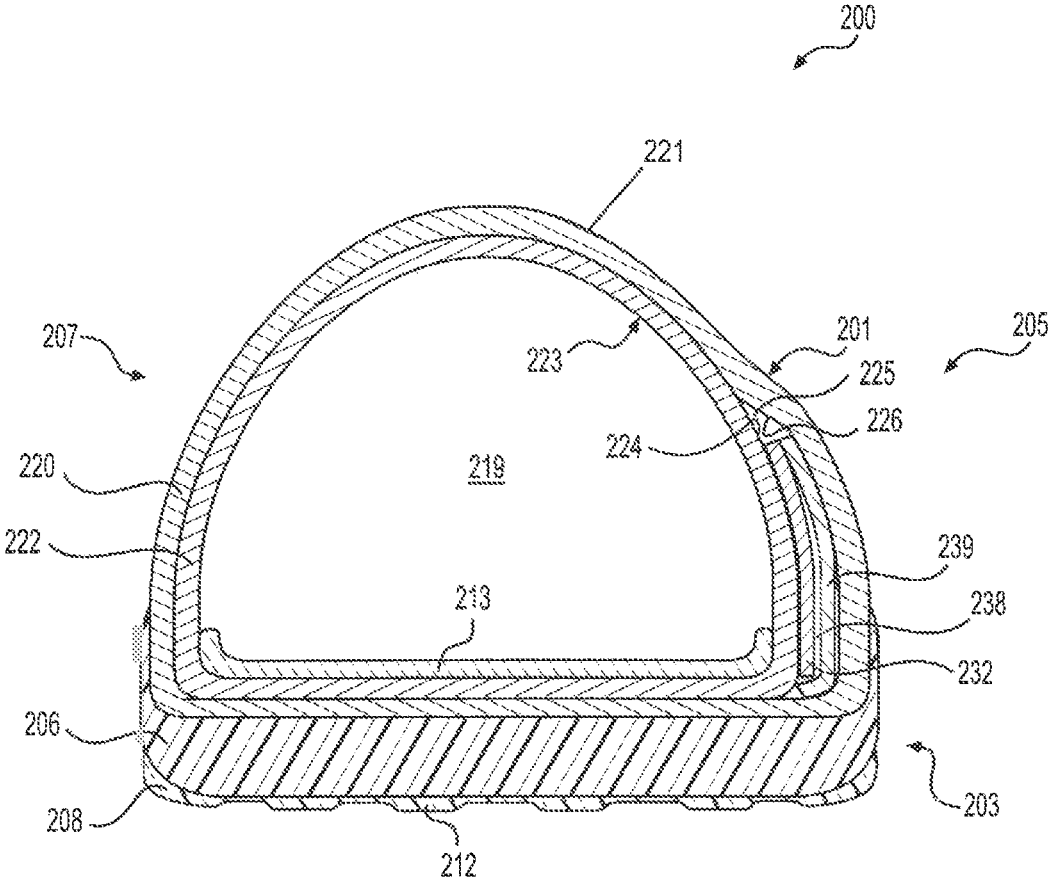
FIG. 10 is a cross-sectional view of a forefoot region of the embodiment of the article of footwear shown in FIG. 9, where the cross-section is taken along line 10-10.
Figure 11:
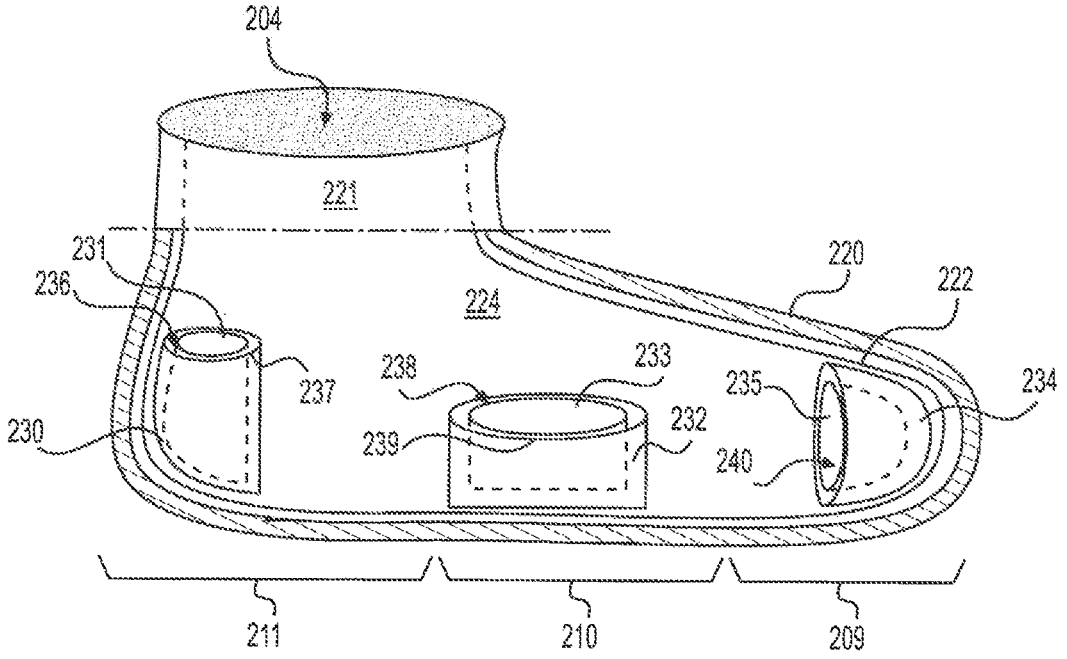
FIG. 11 is a partial sectional view of an embodiment of an upper of the article of footwear shown in FIG. 9 showing an exterior surface of an inner layer of the upper.

As shown in the cross-sectional view of FIG. 10, which is taken along line 10-10 of FIG. 9 and through second zonal pocket 232, second zonal pocket 232 is disposed in an interstitial space 225 formed between outer knit layer 220 and inner knit layer 222 on medial side 205 of upper 201. Though second zonal pocket 232 is discussed, the same principles of placement, construction, and performance may apply equally to any zonal pocket discussed with respect to this or any other embodiment.

As illustrated in FIG. 10, a second pocket panel 239 extends between outward-facing surface 224 and inward-facing surface 226 within interstitial space 225. In some embodiments, second pocket panel 239 may be attached to outward-facing surface 224, while in other embodiments, pocket panel 239 may be attached to inward-facing surface 226. In some embodiments, second pocket panel 239 may be formed integrally (e.g., formed with a common knit structure on a knitting machine) with at least one of second outer knit layer 220 and/or second inner knit layer 222. In other embodiments, second pocket panel 239 may be formed separately and then sewed, adhered, heat bonded, and/or welded to at least one of outer knit layer 220 and inner knit layer 222.

Second pocket panel 239 may define a second pocket interior 238. In the illustrated embodiment, second pocket interior 238 is defined by second pocket panel 239 and outward-facing surface 224. In other embodiments, second pocket interior 238 may be defined by second pocket panel 239 and inward-facing surface 226. Thus, one of outer knit layer 220 and inner knit layer 222 may form one wall of a pocket while the other wall of the pocket may be formed from second pocket panel 239. In some embodiments, another pocket panel may be included to define another wall of second pocket interior 238.

Second pocket interior 238 may configured to receive second zonal insert 233. In the illustrated embodiment, second zonal insert 233 is positioned between second pocket panel 239 and outward-facing surface 224. In other embodiments, second zonal insert 233 may be positioned between second pocket panel 239 and inward-facing surface 226. In other embodiments, second pocket panel 239 may be eliminated entirely so that second zonal insert 233 may be positioned in interstitial space 225. Pocket panel 239 generally serves the purpose of holding second zonal insert 233 in a specific location within upper 201. In embodiments that do not utilize a pocket panel like second pocket panel 239, the pocket may be formed by attaching a portion of second outer layer 220 directly to inner knit layer 222, such as with integrated knitting, stitching, adhesive bonding, heat bonding, and/or welding.

Figure 12:
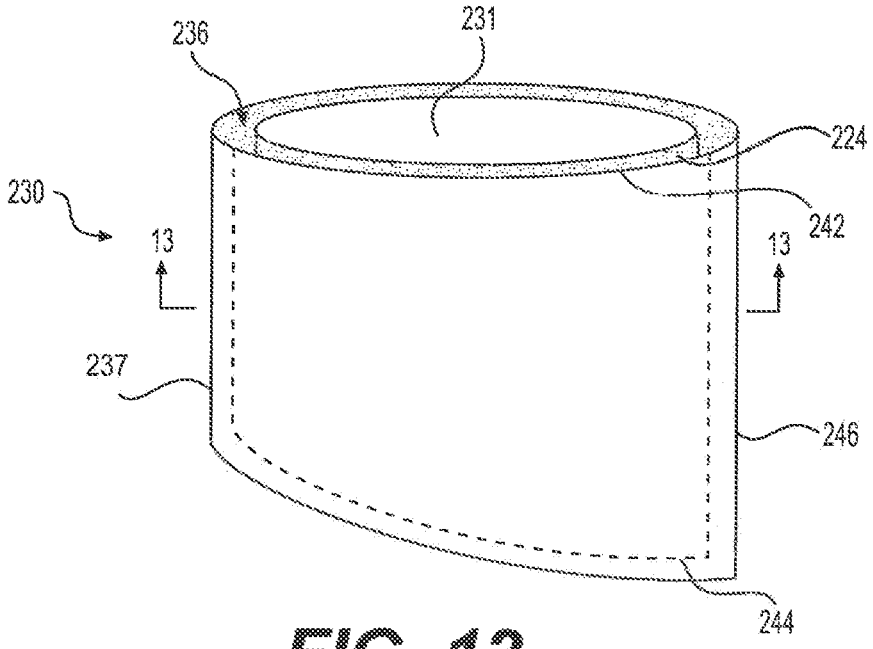
FIG. 12 depicts an embodiment of a zonal pocket.
Figure 13:
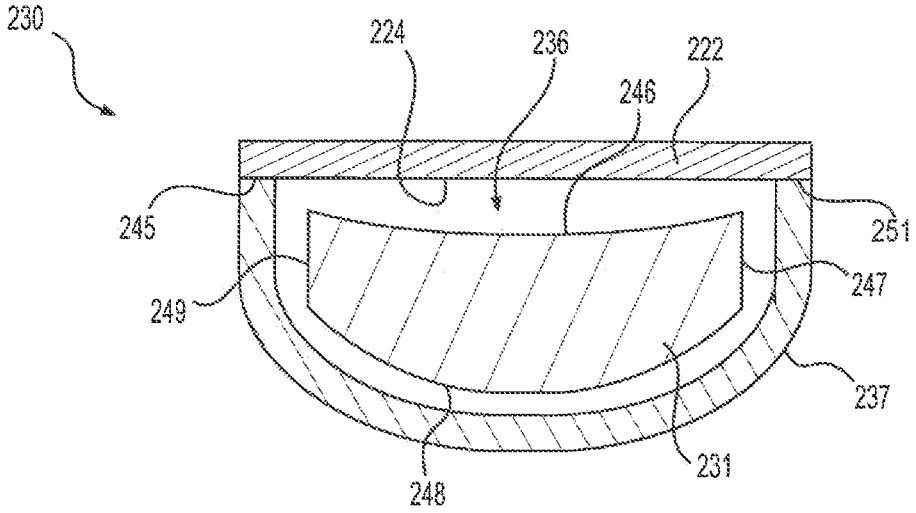
FIG. 13 is a cross-sectional view of an embodiment of a zonal pocket, where the cross-section is taken along line 13-13 of FIG. 12.

The structure of a pocket, in particular, first zonal pocket 230, is shown in detail in FIGS. 12 and 13. As depicted, first zonal pocket 230 is formed by associating first pocket panel 237 with outward-facing surface 224. Therefore, outward-facing surface 224 forms a first wall of first pocket interior 236 while first pocket panel 237 forms an opposite wall of first pocket interior 236. First pocket panel 237 may be coupled to outward-facing surface 224 on three edges, as denoted by the panel attachment line 244. The attachment of first pocket panel 237 is shown further in FIG. 13, which is a cross-sectional view of FIG. 12. First panel attachment 251 and second panel attachment 245 may affix opposite edges of first pocket panel 237 to outward-facing surface 224. The attachment 245 may include sewing, adhesive bonding, heat bonding, welding, or any other suitable device or method.

The attachment of first pocket panel 237 to outward-facing surface 224 may advantageously allow for easy access into first pocket interior 236. As shown best in FIG. 12, a pocket lip 242 may not be attached to outward-facing surface 224, and pocket lip 242 may be a free end of first pocket panel 237 that can be pulled away from outward-facing surface 224 to permit access into first pocket interior 236. This may allow a manufacturer to slide first zonal insert 231 into first pocket interior 236. The same or a similar structure as first zonal pocket 230 may apply equally to second zonal pocket 232 and third zonal pocket 234.

Zonal inserts 231, 233, and 235 may be configured (e.g., sized, shaped, and formed of a material with particular properties) to provide upper 201 with specific properties proximate zonal pockets 230, 232, and 234. In some embodiments, all zonal inserts 231, 233, and 235 may provide the same property to upper 201. Alternatively, each zonal insert may provide different properties, depending upon the location of the zonal insert on upper 201. For example, first zonal insert 231 may be sized, shaped, or otherwise configured to act as a heel counter, which may be rigid and stiff compared to the rest of upper 201. Second zonal insert 233 may be sized, shaped, or otherwise configured to act as an arch support, so second zonal insert 233 may be sized, shaped, or otherwise configured to follow the contours of an arch while being supportive and cushioning. Third zonal insert 235 may be sized, shaped, or otherwise configured to act as a toe cap, which may be rigid and stiff compared to the rest of upper 201, but may be made of a more breathable material than that of first zonal insert 231. In some embodiments, one or more zonal properties may be common to more than one or even all zonal inserts, such as cushioning, while other properties vary from zonal insert to zonal insert, such as stiffness and breathability.

Each zonal insert 231, 233, and 235 may optionally be made from the same material, or one or more of the zonal inserts 231, 233, and 235 may be made from different materials. Example materials may include natural or synthetic rubber, foams, polymer sheets or plates, cushioning bladders that may be filled with foams, gas, and/or fluids, combinations of these materials, knit or other textiles, and/or other suitable materials and combinations.

The embodiment(s) of FIGS. 9-13 show that zonal inserts are disposed in the layers of upper 201 so that the zonal inserts are spaced apart/do not touch while portions of upper 201 do not contain any inserts. In other embodiments, such as the embodiment shown in FIGS. 14 and 15, substantially the entirety of an upper 301 may include zonal inserts that are shaped to provide properties to various zones of the upper 301.

Figure 14:
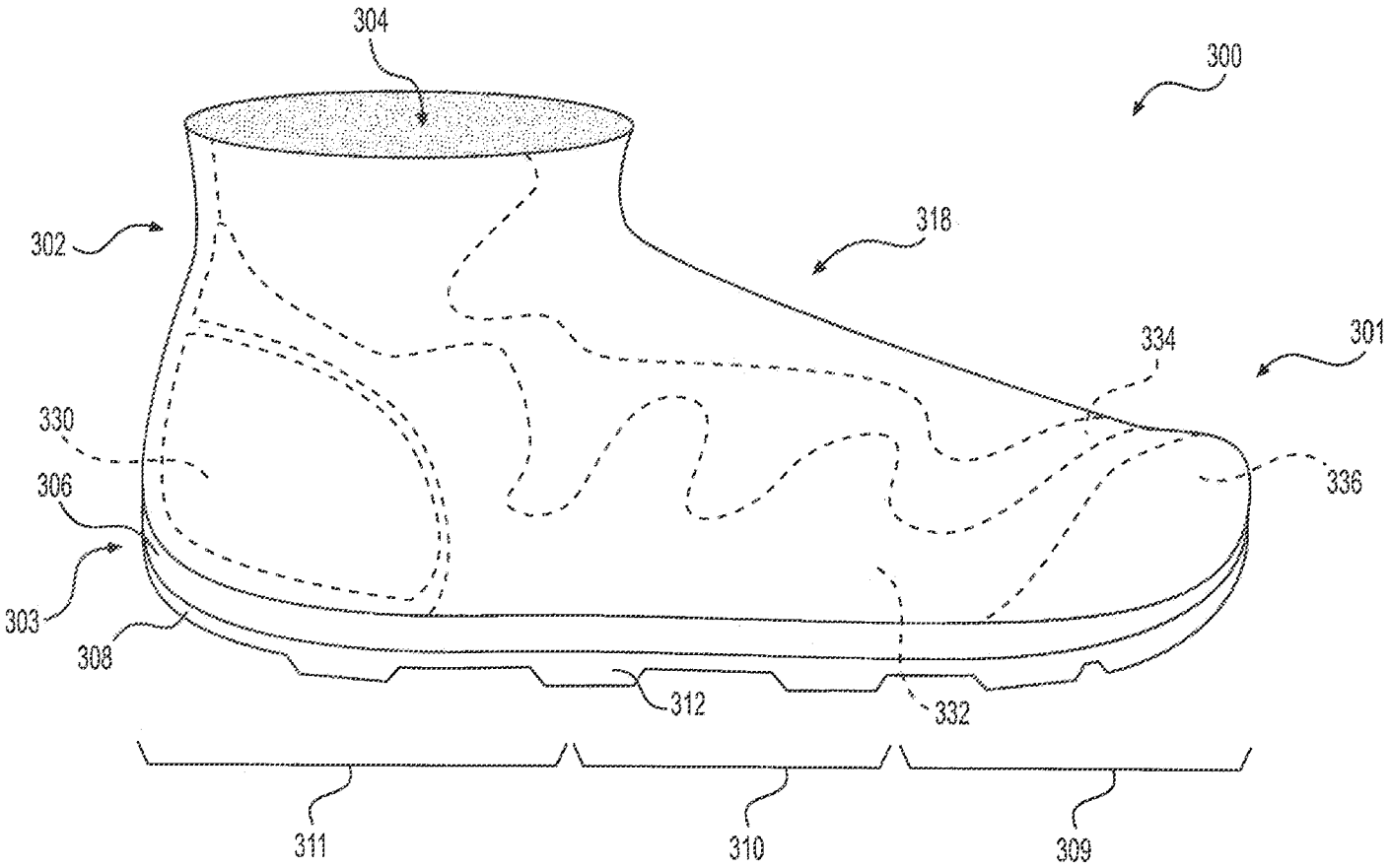
FIG. 14 is a perspective side view of another embodiment of an article of footwear having a multilayer upper with various zonal pockets and inserts.
Figure 15:
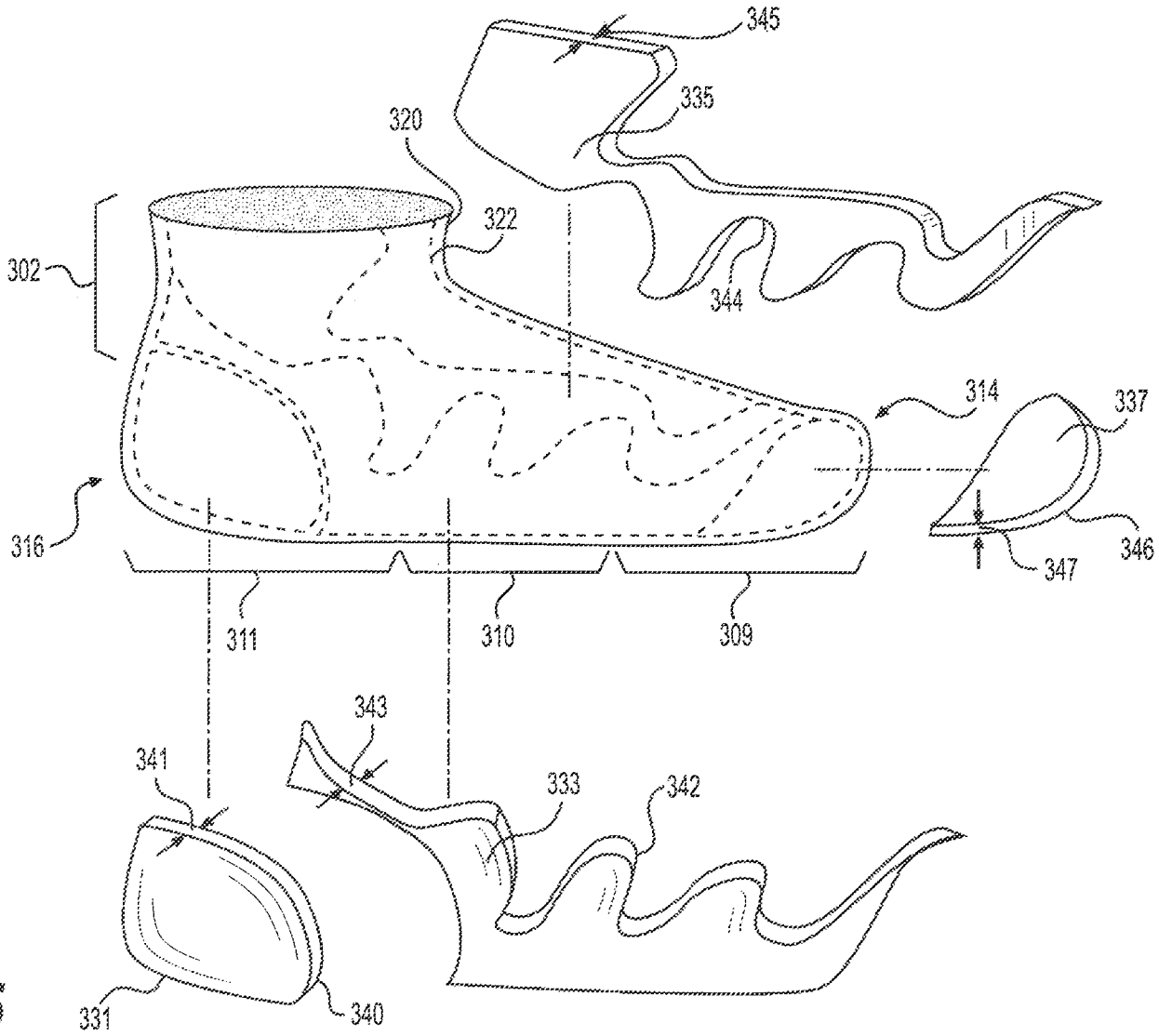
FIG. 15 is a partially exploded view of the article of footwear of FIG. 14, showing various zonal inserts.

The upper 301 of FIGS. 14-15 is similar to the upper 201 of FIGS. 9-13 in many respects. For example, the upper 301 is depicted as including a knit element 318 that is folded to form an outer layer 320 and an inner layer 322, shown in FIG. 15. Knit element 318 may be similar in materials and structure to knit element 218 (of FIG. 9). However, the zonal pockets formed in an interstitial space formed between outer layer 320 and inner layer 322 and the zonal inserts positioned within those pockets are different from the zonal pockets described above. In the illustrated embodiment of upper 301, the zonal pockets and zonal inserts abut each other and have irregular edges that fit together like the pieces of a puzzle. The coverage of upper 301 assists in providing an upright structural shape to upper 301, while the shapes of the pockets and inserts are configured to follow the contours of the foot of a wearer to provide more specific zonal support and properties to the various areas of upper 301 proximate the zonal pockets.

The depicted upper 301 includes a first irregular zonal pocket 330, a second irregular zonal pocket 332, a third irregular zonal pocket 334, and a fourth irregular zonal pocket 336. First irregular zonal pocket 330 and first irregular zonal insert 331 are disposed in heel region 311. First irregular zonal insert 331 may generally have the configuration and properties of at least a portion of a heel counter. First irregular zonal pocket 330 is configured to receive first irregular zonal insert 331 and conforms generally to the shape of first irregular zonal insert 331.

Second irregular zonal pocket 332 and second irregular zonal insert 333 may be partially disposed in heel region 311 and ankle region 302, span third midfoot region proximate sole structure 303, and terminate in forefoot region 309. Second irregular zonal insert 333 may have properties that provide flexible and cushioning support to the portions of upper proximate second irregular zonal insert 333. Additionally or alternatively, second irregular zonal pocket 332 may be configured to receive second irregular zonal insert 333 and may conform generally to the shape of second irregular zonal insert 333. As shown in FIG. 15, second irregular zonal insert 333 may have a second thickness 343. Second thickness 343 may be uniform throughout second irregular zonal insert 333, or second thickness 343 may vary through second irregular zonal insert 333. The variation in thickness may provide thinned portions of irregular zonal insert 333 for enhanced flexibility or thickened portions for enhanced stiffness and support. Second irregular zonal insert 333 may also include a second perimeter edge 342 that is shaped to extend portions of second irregular zonal insert 333 away from sole structure 303 to provide cushioning along the sides of upper 300 while also providing gaps between the portions to enhance flexibility. Similarly, third irregular zonal pocket 334 and fourth irregular zonal pocket 336 may be configured to receive third zonal insert 335 and fourth zonal insert 337, respectively, and each of these elements may include any of the features described above with respect to second irregular zonal pocket 332 and second irregular zonal insert 333. Any of the zonal pockets of upper 301 may be constructed similarly to the zonal pockets of upper 201 (of FIG. 9), but the zonal pockets of upper 301 may have different shapes. Similarly, any of the zonal inserts of upper 301 may optionally be made of similar materials as the zonal inserts of upper 201, but this is not required.

In some embodiments, such as the embodiment shown in FIGS. 16-19, an upper may be knitted to include a visual and/or machine-detectable cue as to the properties of regions and/or may include visible or machine-detectable bite lines to similarly indicate to a technician or a manufacturing machine the intended placement of elements such as a sole structure or a throat opening support. The cue and/or bite lines may additionally or alternatively be included for purposes of providing the article of footwear with desirable aesthetic properties and effects. The features illustrated by FIGS. 16-19 and described below may be used in combination with any of the other embodiments of this disclosure.

Knit element 418 depicted in FIGS. 16-19 may be similar in materials and structure to knit element 218 (of FIG. 9). In some respects, knit element 418 may be similar and has many of the same traits, structures, and performance characteristics of to upper 201 of article of footwear 200.

While article 400 may include zonal pockets and/or zonal inserts such as those described above, these zonal pockets are not shown for the sake of clarity. Instead, article 400 may be provided with zonal features or additional zonal features based on the type of yarn used in a zone, the type of knit stitch or other knit structure used in a zone, and/or the knit density in a zone. For the purposes of this discussion, knit density may be considered to be the number of stitches per unit of length or area.

Figure 16:
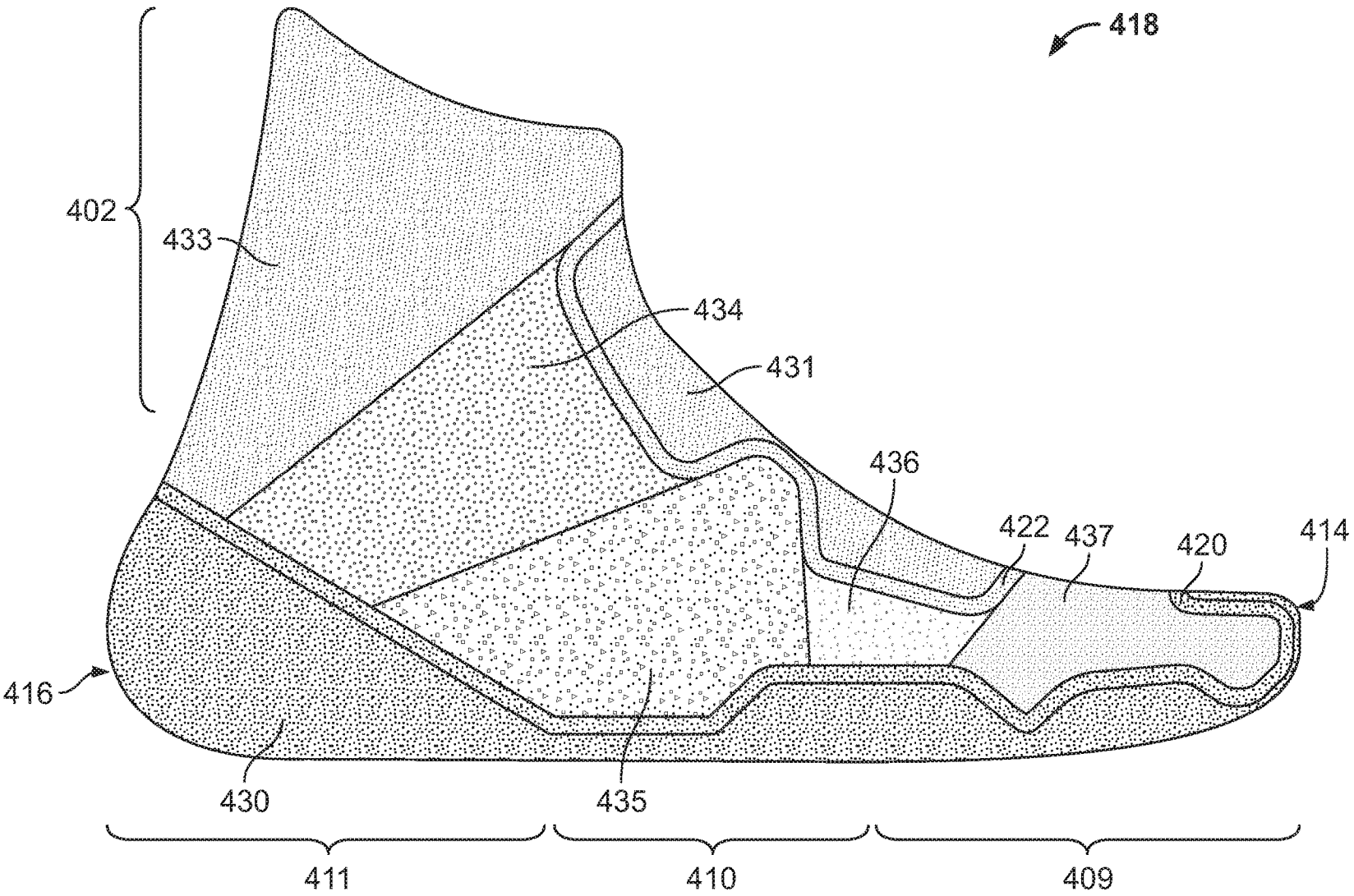
FIG. 16 is an embodiment of an upper for an article of footwear, where the upper includes various zones having visibly different colors and visible bite lines.

FIG. 16 shows several different zones on knit element 418: a first zone 430, a second zone 431, a third zone 433, a fourth zone 434, a fifth zone 435, a sixth zone 436, and a seventh zone 437. Each of these zones may have different structural, performance, and/or aesthetic properties. In addition to type of yarn used in a zone, the type of knit stitch or other knit structure used in a zone, and/or the knit density in a zone, some of the differing properties of the knit element 418 may include stretch resistance, breathability, and stiffness.

In the embodiment of FIG. 16, first zone 430 spans from heel 416 to toe 414 along a lowermost portion of knit element 418. First zone 430 may be configured (e.g., with certain materials and/or surface characteristics) to receive a sole structure. In some embodiments, first zone 430 may be stiffer than other zones to form a stable surface for receiving a sole structure. In some embodiments, first zone 430 may be thicker than other zones to form a more comfortable surface for a foot. In some embodiments, first zone 430 may include more thermoplastic polymer yarns than other zones so that a sole structure may be readily heat bonded and/or welded to first zone 430. In some embodiments, first zone 430 may include a type of yarn that is more compatible with an adhesive than the other zones so that first zone 430 may be more easily adhesive bonded to a sole structure. In some embodiments, first zone 430 may be a combination of any of these properties.

Second zone 431 extends from midfoot region 410 and into forefoot region 409 from a forward part of ankle region 402 along a top of knit element 418. In some embodiments, second zone 431 may be more elastic than other regions so that second zone 431 may stretch to accommodate a foot insertion and return to an original size to secure knit element 418 to the foot. In some embodiments, second zone 431 may be configured to receive a lacing system reinforcing structure. When included, the lacing system may include eyelets, which may be punched out of the second zone 431 (e.g., post-knitting), or may be knitted directly into second zone 431. In embodiments with knitted eyelets, the eyelets may be formed by knitting float stitches (for example a one- or two-stitch float on a circular knitting machine). Each eyelet may include an entrance and an exit, each of which may include one or more yarns selected for durability and abrasion resistance. For example, knitted eyelets may comprise high tenacity yarns and/or thermoplastic yarns activated by suitable post-processing step. In some embodiments, second zone 431 may be thicker than other zones to provide additional comfort to the top of a foot proximate the laces. In some embodiments, second zone 431 may include more thermoplastic yarns than other zones so that a reinforcing structure may be readily heat bonded and/or welded to second zone 431. Optionally, second zone 431 may include a type of yarn that is more compatible with an adhesive than the other zones so that second zone 431 may be more easily adhesive bonded to a reinforcing structure. In some embodiments, second zone 431 may be a combination of any of these properties.

Third zone 433 may be positioned primarily in ankle region 402. Third zone 433 may be significantly more elastic and have greater recovery capabilities than other zones, even than second zone 431, so that third zone 433 may stretch to accommodate a foot insertion and return to an original size to secure knit element 418 to the ankle of a user.

Fourth zone 434 may be positioned adjacent third zone 433 and between first zone 430 and second zone 431. Fourth zone 434 may be positioned proximate a portion of knit element 418 designed to cover a portion of a malleolus area of a user's foot. In some embodiments, fourth zone 434 may have stretch properties similar to third zone 433, but may also have cushioning properties or other protective properties to assist in protecting the ankle of a wearer. In some embodiments, fourth zone 434 may be stiffer and/or less stretchy than third zone 433 to inhibit any potential rolling motion of a user's ankle. For example, fourth zone 434 may be selectively knit with yarns having thermoplastic characteristics (e.g., that stiffen when heat activated) in order to provide ankle support.

Fifth zone 435 may be positioned adjacent to fourth zone 434 and between first zone 430 and second zone 431. In some embodiments, fifth zone 435 may be stiffer than the surrounding zones to provide stability to knit element 418. For example, fifth zone 435 may be selectively knit with yarns having thermoplastic characteristics (e.g., that stiffen when heat activated) in order to provide medial and lateral support.

Sixth zone 436 may be positioned adjacent to fifth zone 435 and extends between first zone 430 and second zone 431. In some embodiments, sixth zone 436 may be less stiff than the surrounding zones to increase the flexibility of knit element 418 proximate the toe joints of a user.

Seventh zone 437 may be positioned in fourth forefoot region 409 and is configured to cover the toes of a user when the user's foot is inside knit element 418. In some embodiments, seventh zone 437 may be more breathable than the surrounding zones. In other embodiments, seventh zone 437 may incorporate materials, such as yarns with thermoplastic polymer materials, that aid in the formation of toe seam 132, as described above.

Figure 17:
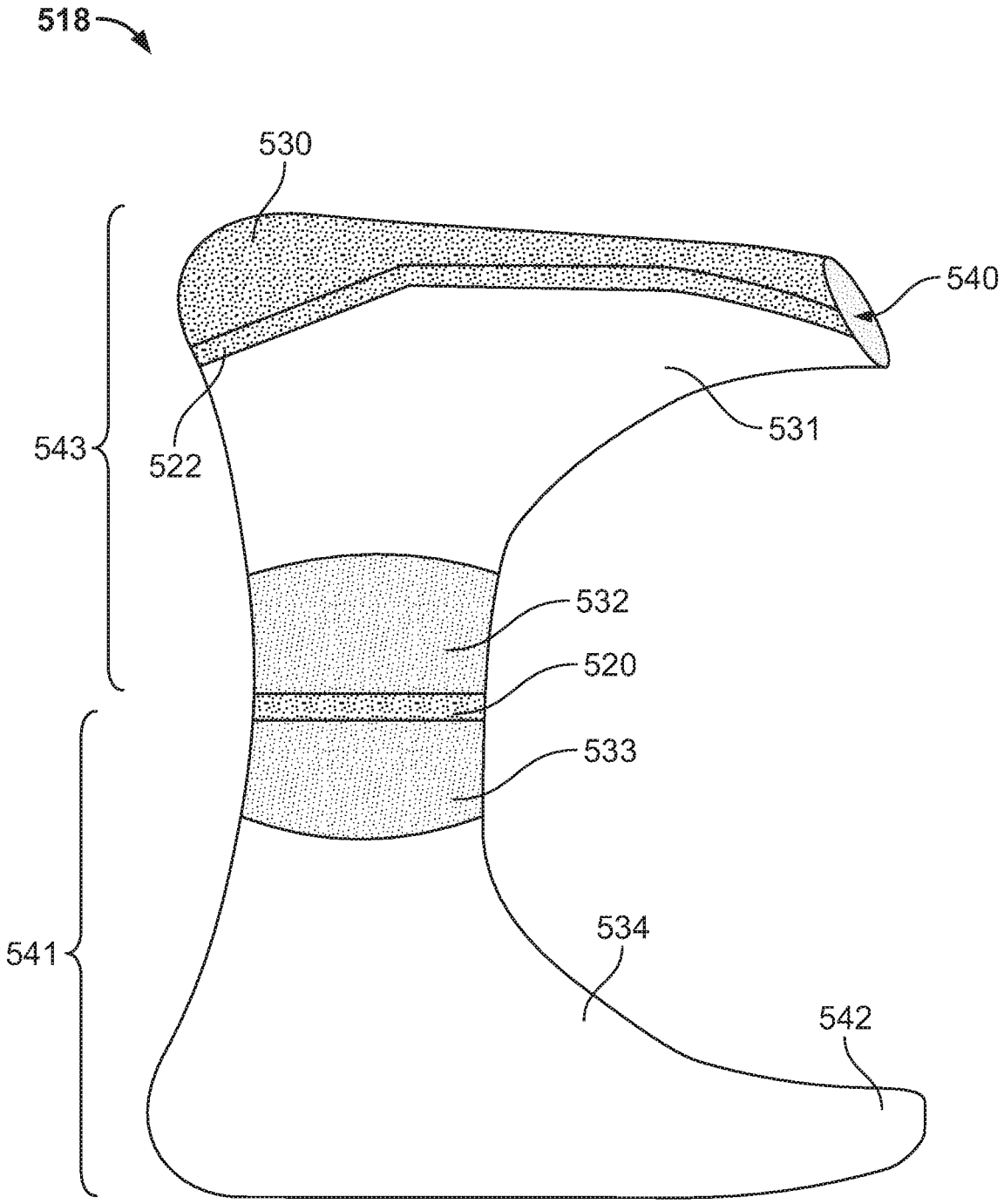
FIG. 17 is an embodiment of a knit element with knit-in zones and bite lines, where the knit element may be used to form a multilayer upper with visible bite lines.

FIG. 17 shows an embodiment of an unfolded element 518 that may be folded or otherwise manipulated into a double-layer knit element like knit element 418. Unfolded element 518 may include the same pattern of yarns as shown in FIG. 16, or unfolded element 518 may include a simplified pattern as shown so that a first bite line 522 is positioned on a first part of unfolded element 518 and a second bite line 520 may be positioned between first part 543 and a second part 541 of unfolded element 518. The simplified pattern may include a first area 530 having first zonal properties, a second area 531 having second zonal properties, a third area 532 having third zonal properties, a fourth area 533 having fourth zonal properties, and a fifth area 534 having fifth zonal properties, and the like. The zonal properties may be any of the types of zonal properties noted above with respect to knit element 418, or any other suitable type. In this simplified embodiment, second area 531 may have similar or substantially identical properties to fifth area 534, and third area 532 may have similar or substantially identical properties to fourth area 533.

FIG. 17 shows an embodiment of unfolded element 518 where unfolded element 518 has a generally tubular, sock-like configuration. First part 543 and second part 541 are nearly identical in shape, though mirror-images or oppositely-oriented. In some embodiments, first part 543 and second part 541 may have a foot-like shape similar to unfolded element 138, discussed above.

In the illustrated embodiment, first part 543 includes an open toe 540, and second part 541 has a closed toe 542, where the edges of the tubular element have been knitted or otherwise joined together. In some embodiments, closed toe 542 may also be left open. In such embodiments, closed toe 542 may include a seam as discussed below.

Unfolded element 518 may be folded or otherwise manipulated in much the same way as unfolded element 138 discussed above with reference to FIGS. 5-8. However, unfolded element of FIG. 17 may additionally include second bite line 520 for use as a guide for the folding process, while unfolded element 138 (of FIGS. 5-8) shows no such guide line. A folding machine may use sensors such as laser detection systems or visual inspection systems that utilize captured images of unfolded element 518 and bite line 520 to detect where the main fold should be, while a technician may be able to use bite line 520 as a simple visual guide for accurate folding. Quality control inspection devices and inspectors may find that second bite line 520 or other visual/detectable cues on second unfolded element 518 may provide for faster and more accurate inspection.

Figure 18:
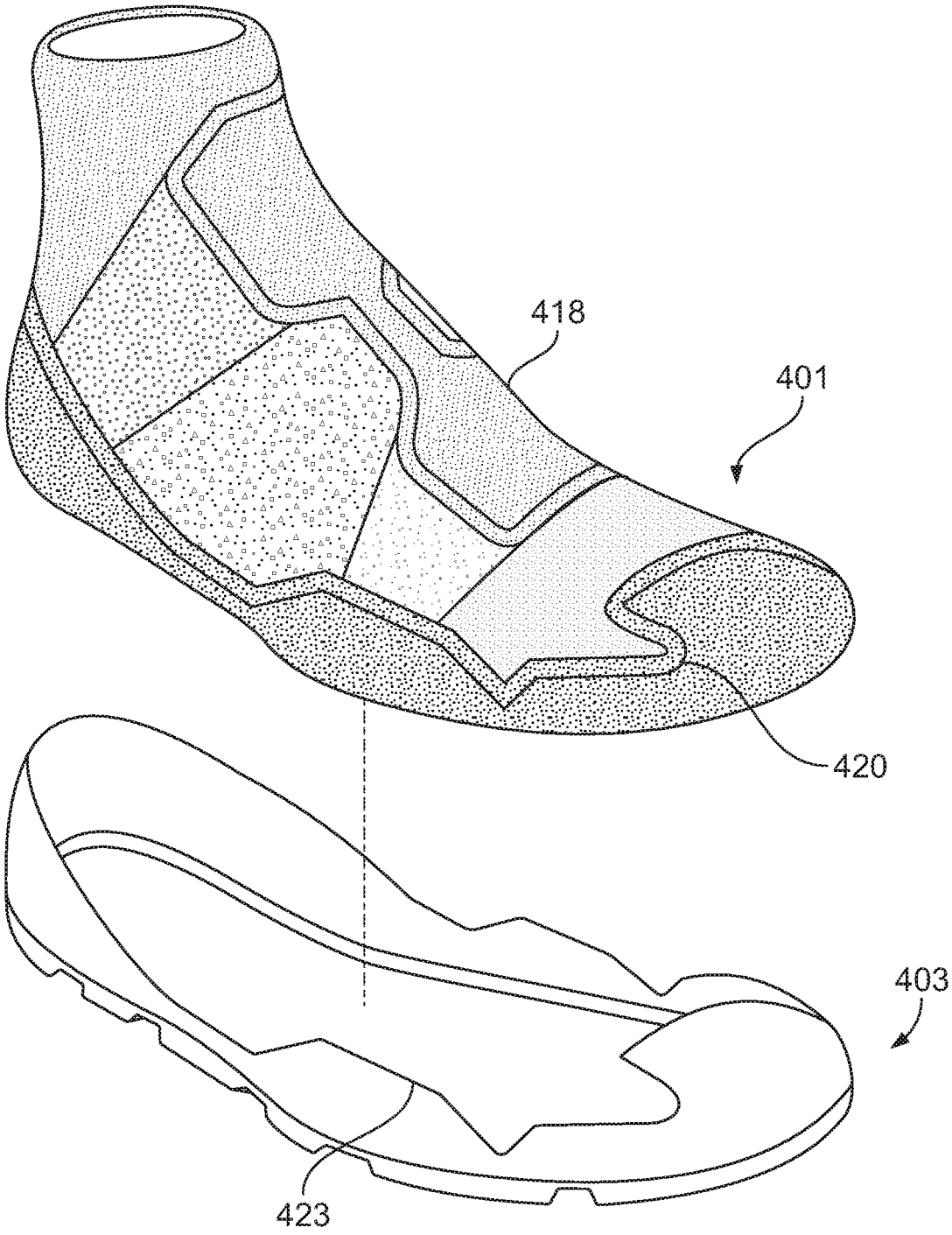
FIG. 18 illustrates a step of affixing an embodiment of an upper with a visible bite line with an embodiment of a sole structure.
Figure 19:
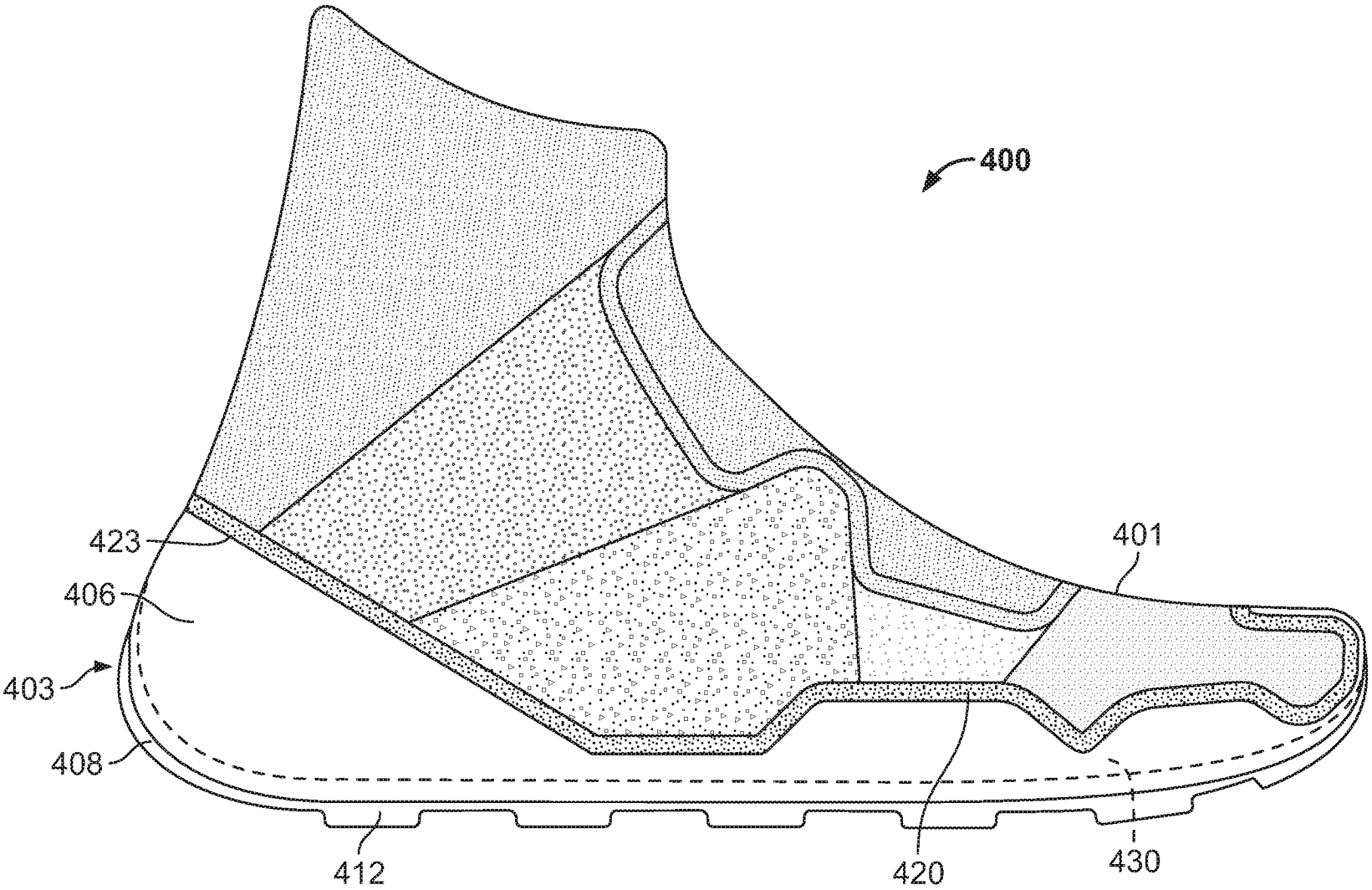
FIG. 19 is an embodiment of an article of footwear with a visible bite line with an embodiment of a sole structure attached to the upper proximate the visible bite line.

FIGS. 18 and 19 show an embodiment of how bite line 420 may be used to guide the placement of a sole structure 403 onto an upper 401 that includes knit element 418. As shown in FIG. 18, sole structure may include a perimeter edge 423 configured (e.g., sized and shaped) to follow the same contours as bite line 420. While shown in the illustrated embodiment as an irregular edge, perimeter edge 423 may instead have a smooth edge or a different contour. Bite line 420 and perimeter edge 423 may be aligned so that perimeter edge 423 follows the contours of bite line 420. FIG. 19 shows article 400 with sole structure 403 affixed to upper 401 so that sole structure 403 covers first zone 430 so that perimeter edge 423 follows first bite line 420. In other embodiments, perimeter edge 423 may obscure part or all of first bite line 420 when positioned onto upper 401. Sole structure 403 may be affixed to upper 401 using techniques including but not limited to sewing, adhesive bonding, heat bonding, and/or welding.

Figure 20A:
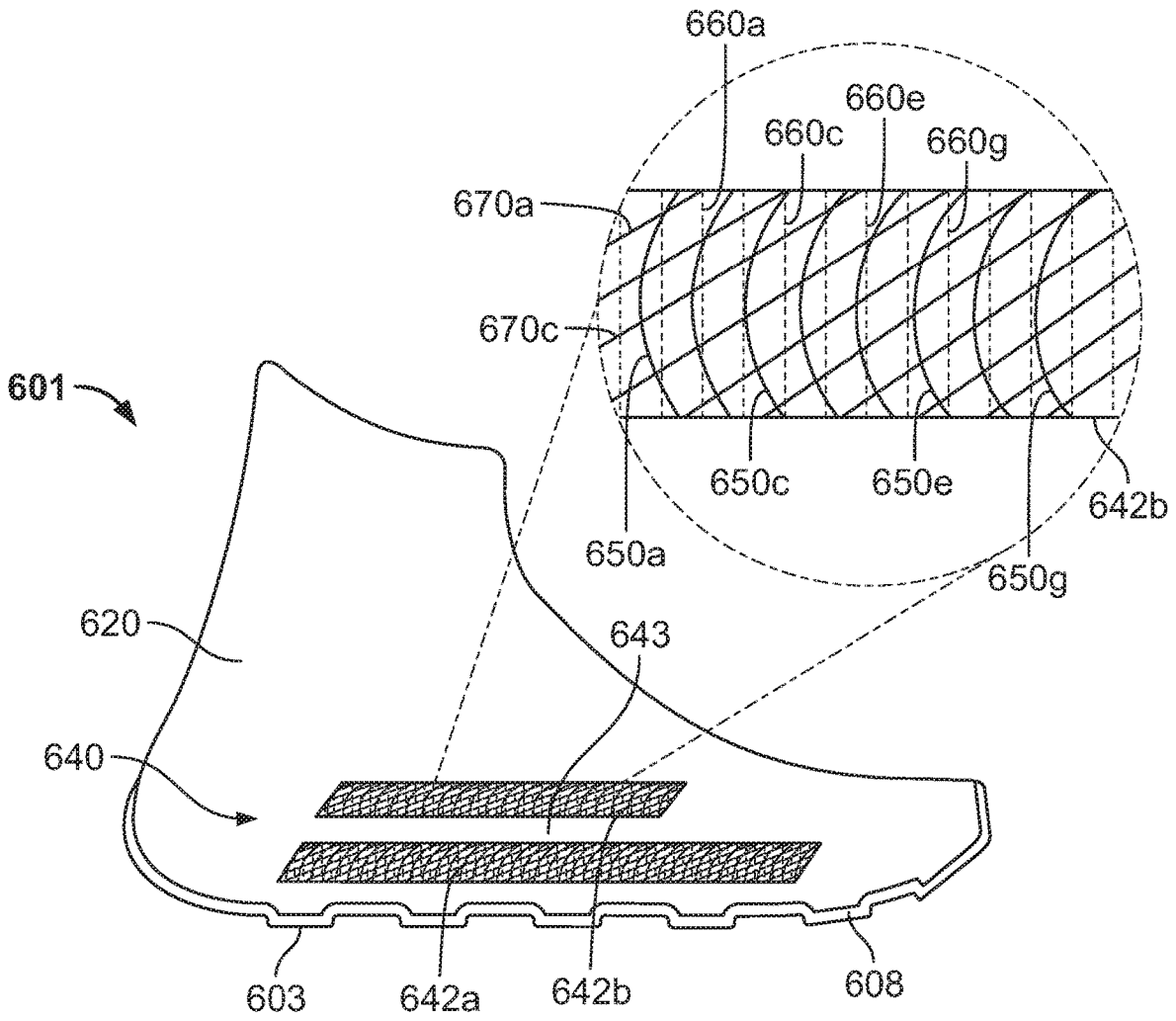
FIG. 20A is an embodiment of an article of footwear with a retention system in a first state.
Figure 20B:
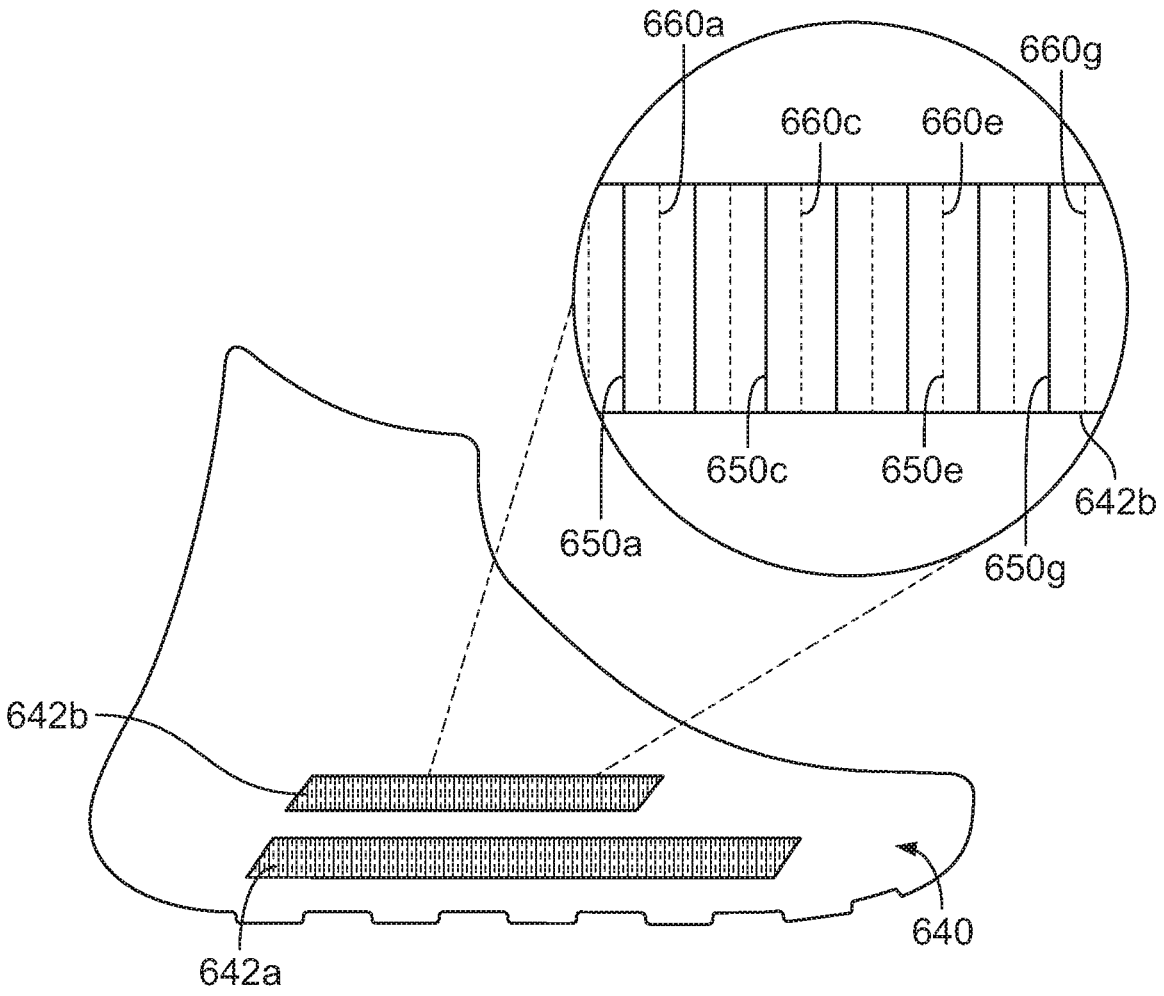
FIG. 20B is the embodiment of an article of footwear shown in FIG. 20A, where the retention system is shown in a second state.

FIGS. 20A-B illustrate a knitted component 601 including an outer knit layer 620 pulled over an inner knit layer (not shown), and further incorporating a sole structure 603, where the outer knit layer 620 incorporates a retention system 640 for exerting a tension force on a wearer's foot. The retention system 640 may be incorporated into retention zones 642 which may be preferably located on the medial and/or lateral portions of the outer knit layer 620 and extend longitudinally along the knitted component 601. The retention system 640 may include one or more first yarns 650 (such as 650 *a*, 650 *c*, 650 *e*, and 650 g) configured to provide medial-to-lateral support (e.g., medial-to-lateral lock-out) when a wearer places a foot into the knitted component 601. The retention system 640 may additionally and optionally include one or more second yarns 660 (such as depicted second yarns 660 *a*, 650 *c*, 650 *e*, and 650 g) for biasing the retention system 640 to a first state when a wearer's foot is not positioned within the knitted component 601. Additionally, the retention system 640 may optionally include one or more third yarns 670 (such as the depicted third yarns 670 *a*, 670 *c*) that shield at least one first yarn 650 from abrasion, snagging, and other causes of damage while advantageously preserving ventilation and visibility of the first yarns.

Still with reference to FIGS. 20A-B, the first yarns 650 *a-g* may be knitted to form intermeshed loops of outer knit layer 620 or may be inlaid within intermeshed loops of outer knit layer 620, and may generally have an orientation substantially in the medial and lateral directions, in the heel and forefoot directions, or in other orientations. It is also possible for the first yarns 650 *a-g* to include at least one first yarn 650 that is inlaid and different first yarn(s) 650 that are looped. Optionally, when the retention system 640 includes first yarns 650 with knitted loops, the first yarns 650 may include floating portions that float (i.e., extend without a loop) past a series of wales. The floating portions may be formed when the floating portions of the first yarns 650 skip (i.e., extend past without engaging) a series of consecutive needles on a needle bed during when knitting a course during a knitting process. The needle bed may be a needle bed of a circular knitting machine. The course-wise length along each first yarn 650 between the loops immediately adjacent to the ends of the floating portion may be referred to as the float length. When first yarns 650 are taut, the float length may form a relatively straight dimension that may be parallel to and define a course-wise dimension of the retention zones 642 *a-b* (i.e., the vertical dimension from the perspective of FIG. 20A). When the first yarns 650 are not taut, the float length may not form a relatively straight dimension, and may not define the course-wise dimension of the retention zones 642 *a-b*. The number of consecutive floated courses of the first yarn 650 may generally define a wale-wise dimension of the retention zones 642 *a-b* (i.e., the horizontal dimension from the perspective of FIG. 20A). This knit structure results in each knitted first yarn 650 being loose from the rest of the knitted component within the retention zones 642 *a-b*. Because the first yarns 650 have a nominal stitch length within the float length, and because the first yarns 650 may be constructed from a material with low stretch, the first yarns 650 may have very low stretch along the course-wise direction (depicted as vertical) within the retention zone 642 (at least when the first yarns 650 are taut).

More than one retention zone 642 may be included. As shown in FIG. 20A, for example, two retention zones 642 *a-b* may be included. Retention zone 642 *a* may be spaced or otherwise separated from the retention zone 642 *b* by a portion 643 of the outer knit layer 620. Portion 643 of the knitted layer may include loops formed by the first yarns 650 *a-g*. Advantageously, providing two (or more) retention zones 642 *a-b* may increase the amount the retention system can displace between its first and second states with respect to the inclusion of only one retention zone 642. Further, it is contemplated that machine limitations may limit maximum float length of first yarns 650 *a-g* due to a maximum number of needles that may be skipped without interrupting the knitting process (e.g., 8 needles according to one test performed by an inventor). Thus, to mitigate this limitation, the portion 643 of the outer knit layer 620 may include loops formed by the first yarns 650 *a-g*.

Suitable materials for the first yarns 650 include yarns formed with low-stretch/low-elasticity materials with relatively high tensile strength, e.g., cables, strands, and cords. Exemplary materials that may be used for first yarns 650 may include strands or fibers having a low modulus of elasticity as well as a high tensile strength, such as tensile strands of monofilament material with a diameter of approximately 0.5 mm-2.0 mm, or fibers such as SPECTRA™, manufactured by Honeywell of Morris Township N.J. Other suitable materials for first yarns 650 include various filaments, fibers, and yarns, that are formed from rayon, nylon, polyester, polyacrylic, silk, cotton, carbon, glass, aramids (e.g., para-aramid fibers and meta-aramid fibers), ultra-high molecular weight polyethylene, and liquid crystal polymer. In comparison with the second yarns 660, the thickness of the first yarns 650 may be greater.

Still with reference to FIGS. 20A-B, the second yarns 660 *a-g* may be knitted to form intermeshed loops of outer knit layer 620 or may be inlaid within intermeshed loops of outer knit layer 620, and may have mechanical properties (e.g., a particular elasticity and resilience) for biasing the retention system 640 to a first state when the knitted component 601 is not on a wearer's foot. Exemplary materials for the second yarns 660 *a-g* may include yarns that incorporates elastane fiber(s), such as those available from E.I. duPont de Nemours Company under the LYCRA trademark. Such yarns may have the configuration of covered LYCRA, for example yarns having a LYCRA core that is surrounded by a nylon sheath. Other fibers or filaments exhibiting elastic properties may also be utilized.

Still with reference to FIG. 20A, the third yarns 670 (shown as 670 *a-c* in FIG. 20A and not shown in FIG. 20B) may be knitted to form a knit structure of intermeshed loops of the outer knit layer 620 or inlaid within intermeshed loops of outer knit layer 620. The third yarns 670 may include yarns with suitable durability, such as monofilament yarns or other yarn with high resistance to abrasion and breakage. In FIG. 20A, third yarns 670 *a-c* are represented schematically, and FIG. 20A does not necessarily correspond to the orientation or stitch type of third yarns 670 *a-c*. Generally, third yarns 670 may be formed from a knit stitch, tuck stitch, or other suitable stitch or other knit structure, and may be oriented as necessary to form a lattice, covering, or other protective knit structure for the first yarns 650. In some embodiments, at least one of the first yarns 650 may reside behind at least one of the third yarns 670 when the outer knit layer 620 is pulled over the inner knit layer 622, so that an exterior surface of at least one of the first yarns 650 is covered by at least one of the third yarns 670. In other words, in use, when a wearer's foot is placed within the knitted component 601, at least one of the first yarns 650 may reside between the wearer's foot and at least one of the third yarns 670, i.e., at least one of the third yarns 670 may reside over at least one of the first yarns 650.

Still with reference to FIG. 20A, before a wearer places a foot in the knitted component 601, the knitted component 601 may assume a relatively limp, sock-like state. The second yarns 670 *a-f* may bias the knitted component 601 to a first state, in which the second yarns 670 *a-f* may assume a contracted state and the first yarns 650 *a-f* may assume a slack state, as shown, where the float length of the first yarns 650 *a-f* is greater than the corresponding course-wise dimension of the retention system. By inserting a foot into the knitted component 601, as shown in FIG. 20B, a wearer stretches the second yarns 670 *a-f* into a second state, at which point the second yarns 670 *a-f* stretch and provide a snug on-foot feel by creating tension in the portion of the knitted component 601 around the bridge of the wearer's foot. Also, by inserting a foot into the knitted component 601, a wearer causes the first yarns 650 *a-f* to become taut, as shown in FIG. 20B. Because the first yarns 650 *a-f* may be constructed of materials with relatively low stretch and high tensile strength, the first yarns 650 *a-f* may experience tensile stress in the second state and tend to resist further elongation. This tends to retain the knitted component 601 on the wearer's foot without additional steps (e.g., tying a lace), and also retain the wearer's foot on the sole structure 603. In other words, the retention system exerts a tension force (e.g., a tension force in the first yarns 650) to retain the knitted component 601 on the wearer's foot. The tension force may also include tensile forces present in the second yarns. In some embodiments, conventional elements like a tongue may be provided. In the illustrated embodiments, however, the sock-like nature of the knit elements may not require a traditional tongue as the ankle region may stretch to accommodate foot insertion and retract to secure the foot snugly within the knitted component. In some embodiments, closure elements can also be included that is used to selectively secure a knitted component to the wearer's foot. A closure element can be of any suitable type, such as a lace. In other embodiments, the closure element(s) may also include one or more buckles, straps, or other suitable implements for securing the knitted component to a wearer's foot. In the illustrated embodiments, however, the knitted component may be configured to be pulled over a user's foot like a sock, and, thus, may not include any additional closure elements. When a closure element is included, the closure element may operate in conjunction with the retention system 640 of FIGS. 20A-20B, but it is also contemplated that the retention force provided by the retention system 640 may render an additional closure element unnecessary.

In further configurations, any of the knitted components disclosed above may include additional elements. For example, upper 101 (of FIG. 1, or any other upper described herein) can include a toe guard in forefoot region that is formed of a wear-resistant material. The upper can additionally include logos, trademarks, symbols, and placards with care instructions and material information. It will be appreciated that any upper disclosed above can include still further elements without departing from the scope of the present disclosure.

The filaments of the nonwoven layers, knitted materials, components, or inserts in any of the embodiments discussed above may include a thermoplastic polymer material. In general, a thermoplastic polymer material melts when heated and returns to a solid state when cooled. More particularly, the thermoplastic polymer material transitions from a solid state to a softened or liquid state when subjected to sufficient heat, and then the thermoplastic polymer material transitions from the softened or liquid state to the solid state when sufficiently cooled. As such, the thermoplastic polymer material may be melted, molded, cooled, re-melted, re-molded, and cooled again through multiple cycles. Thermoplastic polymer materials may also be bonded or fused, as described in greater detail below, to other textile elements, plates, sheets, polymer foam elements, thermoplastic polymer elements, thermoset polymer elements, or a variety of other elements formed from various materials. In contrast with thermoplastic polymer materials, many thermoset polymer materials do not melt when heated, simply burning instead. Although a wide range of thermoplastic polymer materials may be utilized for the filaments of a nonwoven or knitted material or an insert or component, examples of some suitable thermoplastic polymer materials include thermoplastic polyurethane, polyamide, polyester, polypropylene, and polyolefin. Although any of the thermoplastic polymer materials mentioned above may be utilized for the above-discussed embodiments, an advantage to utilizing thermoplastic polyurethane relates to heat bonding and colorability. In comparison with various other thermoplastic polymer materials (e.g., polyolefin), thermoplastic polyurethane is relatively easy to bond with other elements, as discussed in greater detail below, and colorants may be added to thermoplastic polyurethane through various conventional processes.

Although each of the nonwoven layers, knitted materials, components, and/or inserts may be entirely formed from a single thermoplastic polymer material, portions of the nonwoven layers, knitted materials, components, and/or inserts may also be at least partially formed from multiple polymer materials. As an example, an individual filament in a nonwoven or knit may have a sheath-core configuration, wherein an exterior sheath of the individual filament is formed from a first type of thermoplastic polymer material, and an interior core of the individual filament is formed from a second type of thermoplastic polymer material. As a similar example, an individual filament of a nonwoven or a knit may have a bi-component configuration, wherein one half of the individual filament is formed from a first type of thermoplastic polymer material, and an opposite half of the individual filament is formed from a second type of thermoplastic polymer material. In some configurations, any individual filament may be formed from both a thermoplastic polymer material and a thermoset polymer material with either of the sheath-core or bi-component arrangements.

Finally, while the above embodiments have generally referenced structure and manufacture in the form of a shoe, the present embodiments contemplate manufacture of articles other than shoes, such as accessories or other apparel.

While various embodiments of the invention have been described, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. An article of footwear, the article of footwear comprising:

a knitted component;

a first layer of the knitted component located on an inner side of the article of footwear such that the first layer of the knitted component is adjacent to a void;

a second layer of the knitted component, wherein the second layer of the knitted component surrounds the first layer of the knitted component, wherein the first layer is joined to the second layer, and wherein the second layer of the knitted component forms an outer surface of the article of footwear;

an interstitial space formed between the first layer of the knitted component and the second layer of the knitted component;

at least one pocket located within the interstitial space;

wherein the pocket is disposed in a forwardmost end of a toe region of the article of footwear;

and wherein a zonal insert is located within the pocket.

2. The article of footwear of claim 1, wherein the pocket includes a pocket panel.

3. The article of footwear of claim 2, wherein the pocket panel contacts and is fixed to the first layer of the knitted component.

4. The article of footwear of claim 2, wherein the pocket panel is formed of a knitted construction by the first layer of the knitted component.

5. The article of footwear of claim 2, wherein the pocket panel contacts and is fixed to the second layer of the knitted component.

6. The article of footwear of claim 2, wherein the pocket panel is formed of a knitted construction by the second layer of the knitted component.

7. The article of footwear of claim 1, wherein a portion of the first layer of the knitted component is continuous with the second layer of the knitted component in an ankle region of the article of footwear.

8. The article of footwear of claim 7, wherein the first layer of the knitted component and the second layer of the knitted component are secured via at least one common course located in the ankle region of the article of footwear.

9. The article of footwear of claim 1, wherein the knitted component at least partially forms an overfoot portion and an underfoot portion of the article of footwear.

10. The article of footwear of claim 1, wherein the zonal insert is a toe cap.

11. An article of footwear, the article of footwear comprising:

a knitted component;

a first knit portion of the knitted component located on an inner side of the article of footwear such that the first knit portion of the knitted component is adjacent to a void; and a second knit portion of the knitted component, wherein the second knit portion of the knitted component surrounds the first knit portion of the knitted component, wherein the first knit portion of the knitted component is joined to the second knit portion of the knitted component, and wherein the second knit portion of the knitted component forms an outer surface of the article of footwear, wherein the first knit portion of the knitted component includes a multi-layer knit structure that forms a knit pocket disposed in a toe region of the article of footwear, and wherein the knit pocket contains a zonal insert; and wherein an opening of the knit pocket is accessible from a location within an interstitial space located between the first knit portion of the knitted component and the second knit portion of the knitted component.

12. The article of footwear of claim 11, wherein a portion of the first knit portion of the knitted component is continuous with the second knit portion of the knitted component in an ankle region of the knitted component.

13. An article of footwear, the article of footwear comprising:

a knitted component;

a first knit portion of the knitted component located on an inner side of the article of footwear such that the first knit portion of the knitted component is adjacent to a void; and a second knit portion of the knitted component, wherein the second knit portion of the knitted component surrounds the first knit portion of the knitted component, wherein the first knit portion of the knitted component is joined to the second knit portion of the knitted component, and wherein the second knit portion of the knitted component forms an outer surface of the article of footwear, wherein the second knit portion of the knitted component includes a multi-layer knit structure that forms a knit pocket within an interstitial space between the first knit portion and the second knit portion;

wherein the knit pocket is disposed in a forwardmost end of a toe region of the article of footwear, and wherein the knit pocket contains a zonal insert.

14. The article of footwear of claim 13, wherein an opening of the knit pocket is accessible from a location within an interstitial space located between the first knit portion of the knitted component and the second knit portion of the knitted component.

15. The article of footwear of claim 13, wherein a portion of the first knit portion of the knitted component is continuous with the second knit portion of the knitted component in an ankle region of the knitted component.

* * * * *